US009950904B2

(12) United States Patent
Kosuga

(10) Patent No.: US 9,950,904 B2
(45) Date of Patent: Apr. 24, 2018

(54) HOOK BLOCK AND ROPE HOIST

(71) Applicant: KITO CORPORATION, Nakakoma-gun, Yamanashi (JP)

(72) Inventor: Kosuke Kosuga, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 0 days.

(21) Appl. No.: 15/311,766

(22) PCT Filed: May 22, 2015

(86) PCT No.: PCT/JP2015/064822
§ 371 (c)(1),
(2) Date: Nov. 16, 2016

(87) PCT Pub. No.: WO2015/182528
PCT Pub. Date: Dec. 3, 2015

(65) Prior Publication Data

US 2017/0081152 A1 Mar. 23, 2017

(30) Foreign Application Priority Data

May 30, 2014 (JP) ..... 2014-113377

(51) Int. Cl.
*B66C 1/34* (2006.01)
*B66D 3/20* (2006.01)

(52) U.S. Cl.
CPC . *B66C 1/34* (2013.01); *B66D 3/20* (2013.01)

(58) Field of Classification Search
CPC ..... B66C 1/34; B66C 13/04; B66C 13/08; B66D 3/04; B66D 3/20
(Continued)

(56) References Cited

U.S. PATENT DOCUMENTS 3,179,376 A * 4/1965 Botten ..... B66D 3/06 254/401
3,633,961 A * 1/1972 Speransky ..... B66C 1/34 294/82.15
(Continued)

FOREIGN PATENT DOCUMENTS

CN 1833985 A 9/2006
CN 202164047 U 3/2012
(Continued)

OTHER PUBLICATIONS

International Search Report corresponding to Application No. PCT/JP2015/064822; dated Aug. 18, 2015, with English translation.
(Continued)

*Primary Examiner* — Dean J Kramer
(74) *Attorney, Agent, or Firm* — Cantor Colburn LLP

(57) ABSTRACT

A hook block suspended by a wire rope and provided with: sheave shaft parts for rotatably supporting hook sheaves; a connecting shaft inserted into shaft holes that penetrate the sheave shaft parts in the axial direction; brackets which support the sheave shaft parts by fitting the same in engaging holes in first piece parts, which are provided with second piece parts substantially orthogonal to the first piece parts, and in which insertion holes are formed, the insertion holes enabling the insertion of the upper side of a hook in a mutually facing arrangement; a bracket-fixing member supported by the second piece parts above the second piece parts; and a hook support member rotatably arranged above the bracket-fixing member and fixed to the outer periphery of the upper side of the hook.

6 Claims, 20 Drawing Sheets

(58) Field of Classification Search
USPC ..... 294/82.11, 82.12, 82.15
See application file for complete search history.

(56) References Cited

U.S. PATENT DOCUMENTS

| | | | | |
|---|---|---|---|---|
| 4,069,921 | A | 1/1978 | Raugulis et al. | |
| 4,568,118 | A | 2/1986 | Isao | |
| 5,476,247 | A * | 12/1995 | Melder | B66D 3/06 254/401 |
| 2004/0183061 | A1 * | 9/2004 | Winter | B66D 3/06 254/411 |

FOREIGN PATENT DOCUMENTS

| | | | |
|---|---|---|---|
| CN | 102838049 | A | 12/2012 |
| CN | 203079554 | U | 7/2013 |
| CN | 203345956 | U | 12/2013 |
| CN | 103803431 | A | 5/2014 |
| DE | 1274295 | B | 8/1968 |
| DE | 3322350 | C1 | 8/1984 |
| JP | S4936699 | Y1 | 10/1974 |
| JP | S53106973 | U | 8/1978 |
| JP | S55113391 | U | 8/1980 |
| JP | 58131277 | U | 9/1983 |
| JP | S60209497 | A | 10/1985 |
| JP | H0280684 | U | 6/1990 |
| JP | 09156865 | A | 6/1997 |
| JP | 2001240365 | A | 9/2001 |
| JP | 3323854 | B2 | 9/2002 |
| JP | 2013511452 | A | 4/2013 |
| WO | 2011061152 | A1 | 5/2011 |

OTHER PUBLICATIONS

Japanese Notice of Reasons for Rejection corresponding to Application No. JP2014-113377; dated Oct. 18, 2016, with English abstract.

SIPO Notification of First Office Action corresponding to Application No. 201580026674.1; dated Sep. 14, 2017.

Extended European Search Report corresponding to Application No. 15799477.3-1731/3150541 PCT/JP2015064822; dated Dec. 22, 2017.

* cited by examiner

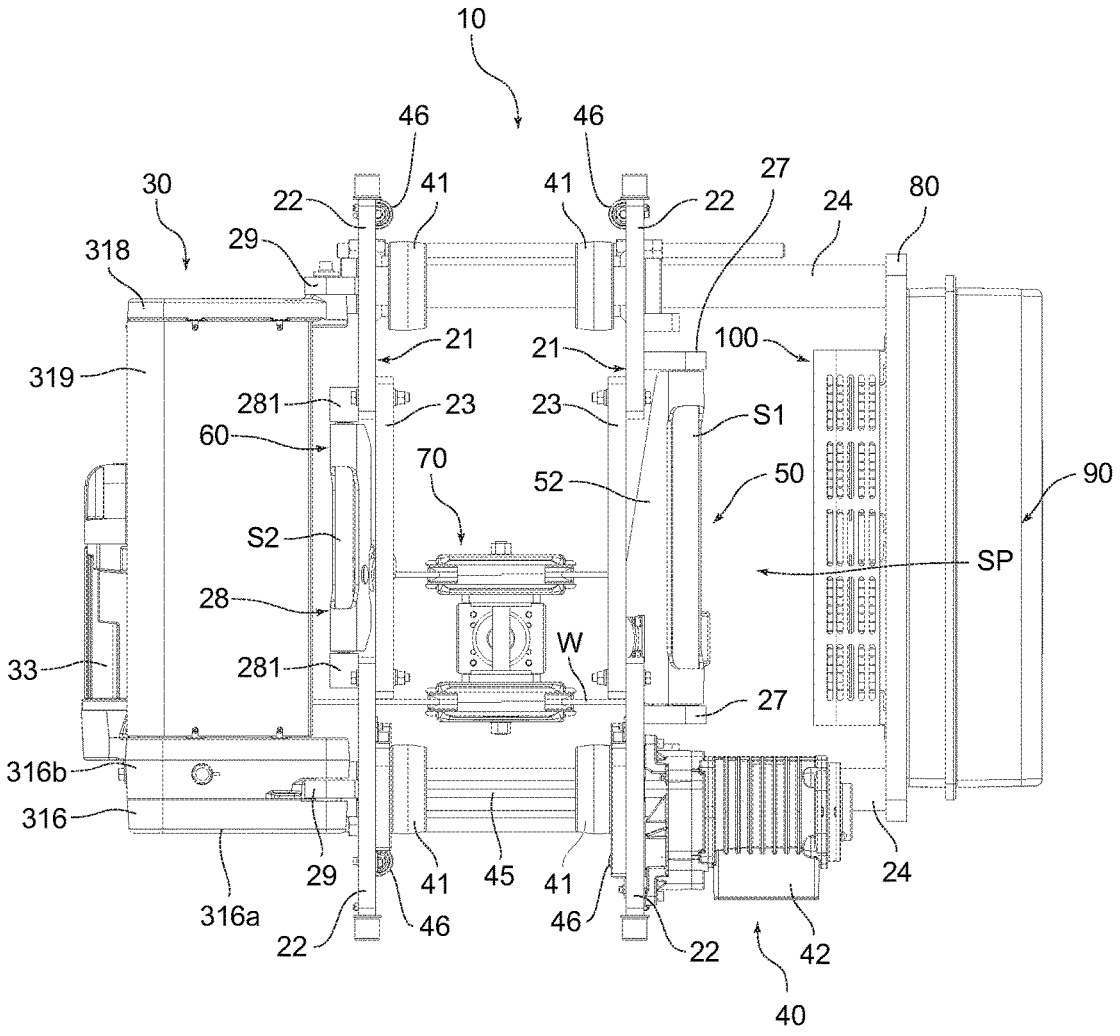
Fig.3
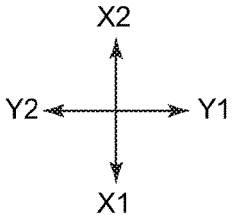

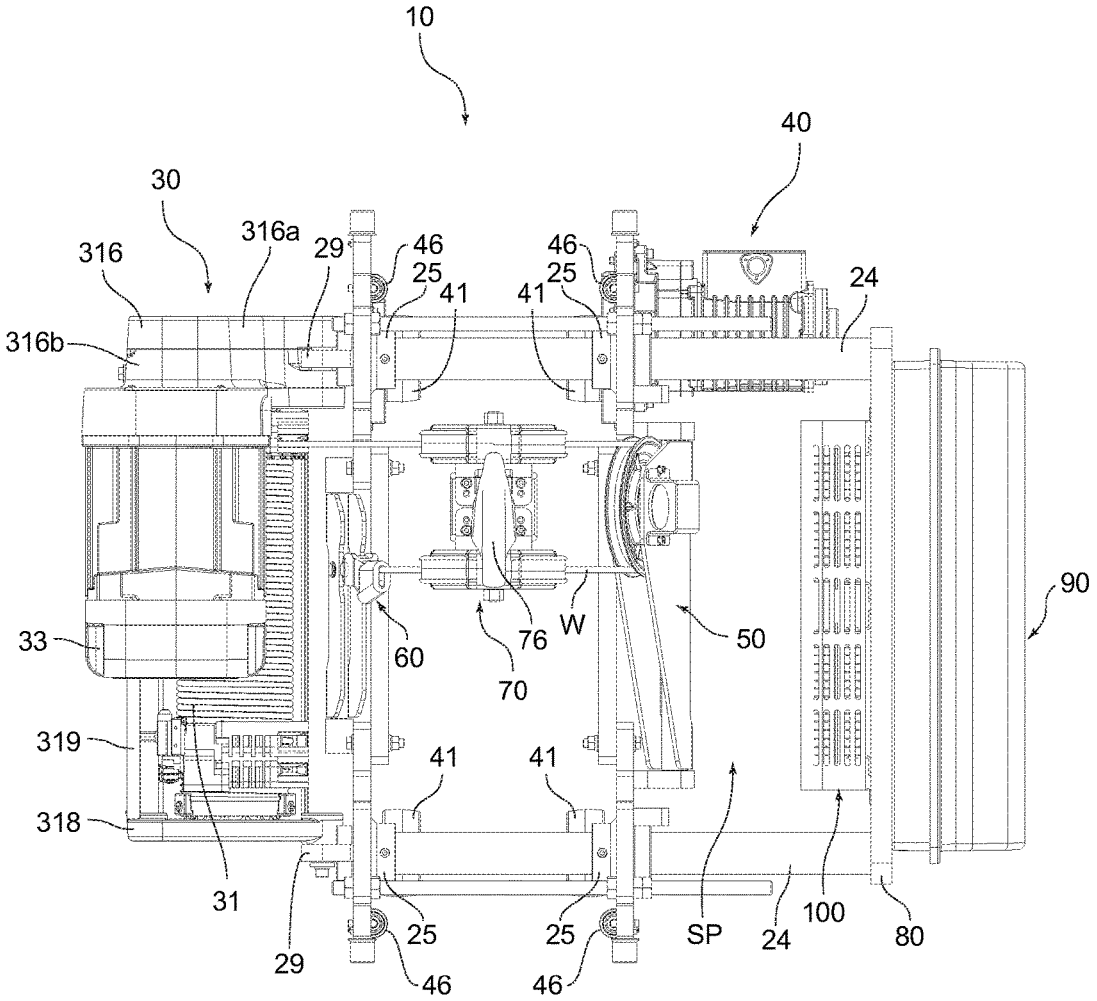
Fig.4
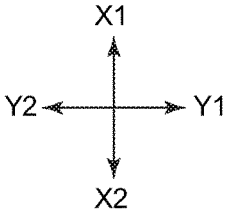

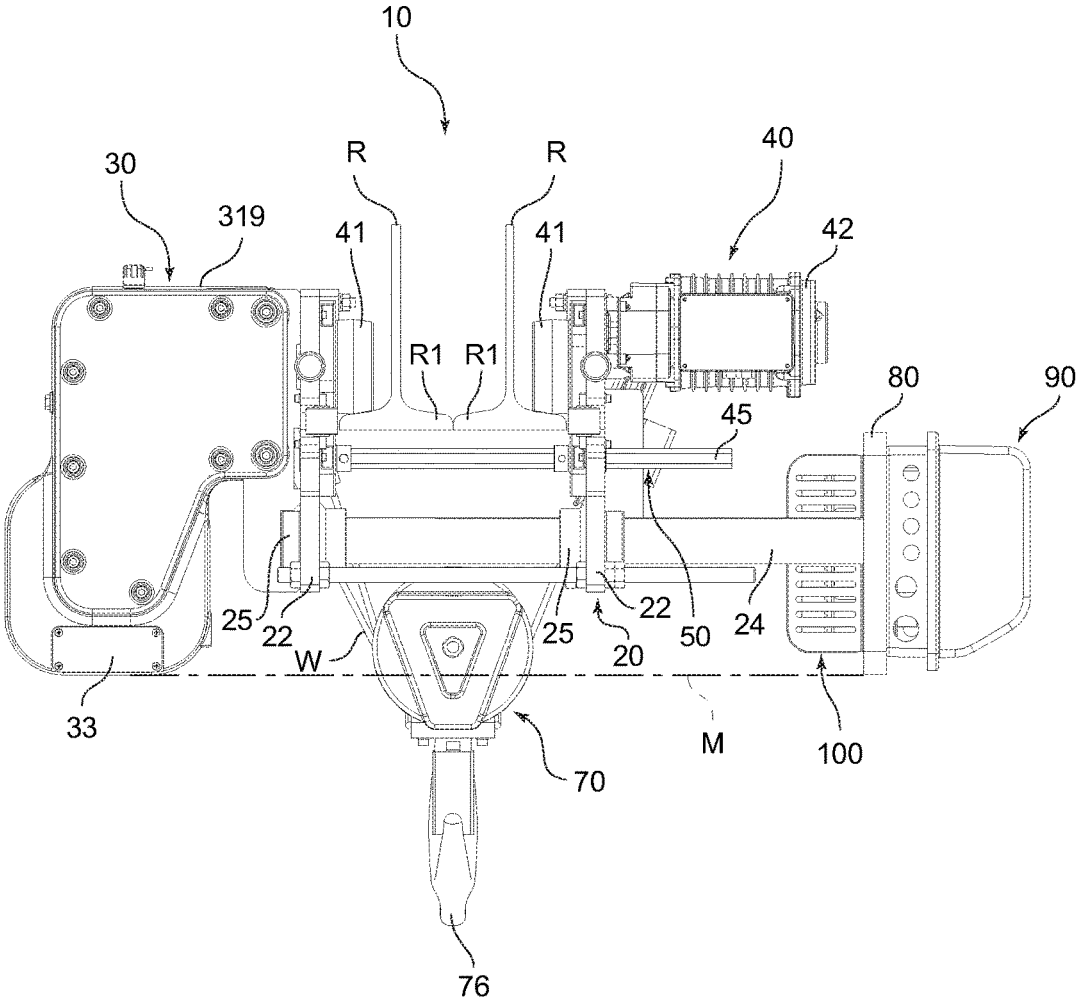
Fig.5
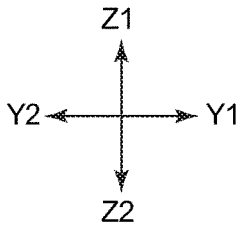

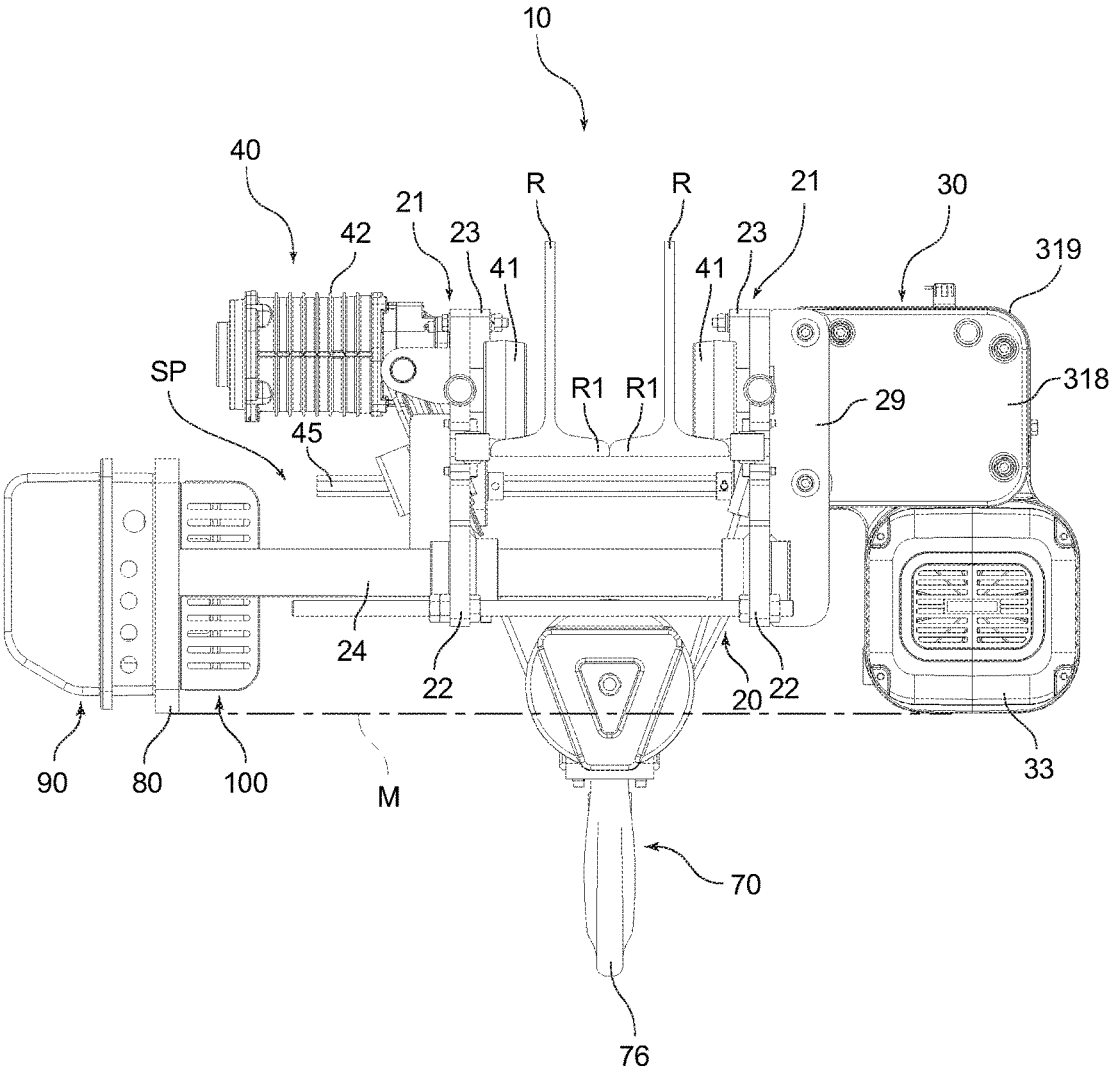
Fig.6
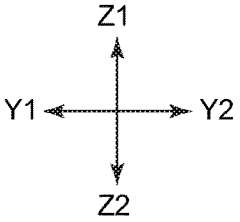

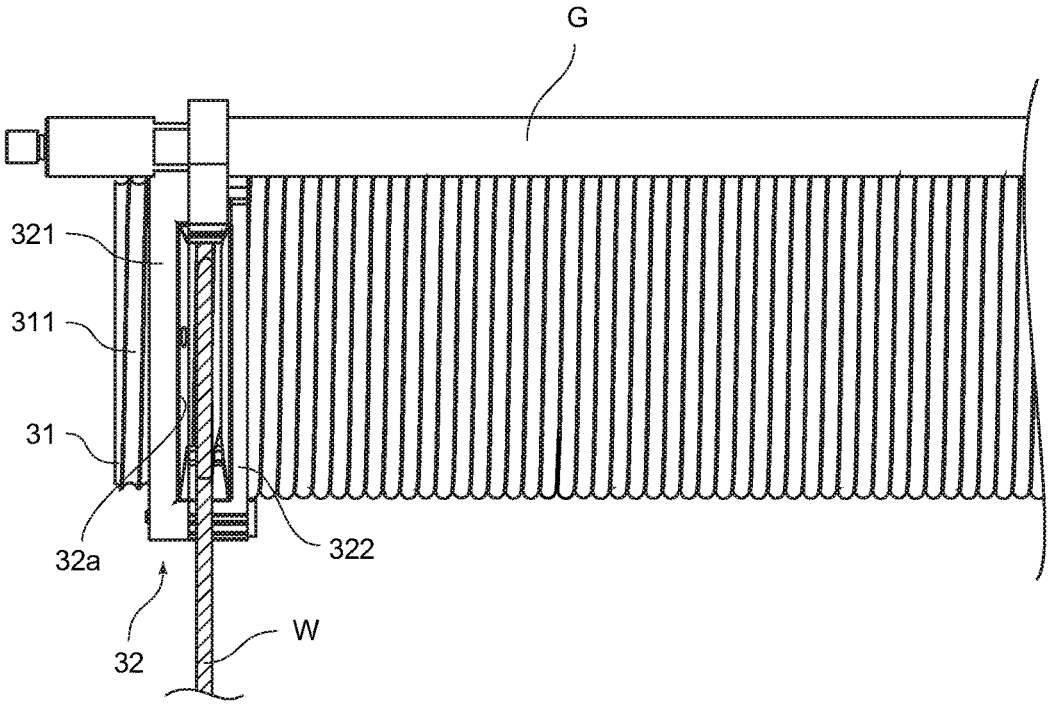
Fig.9
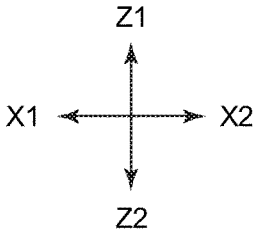

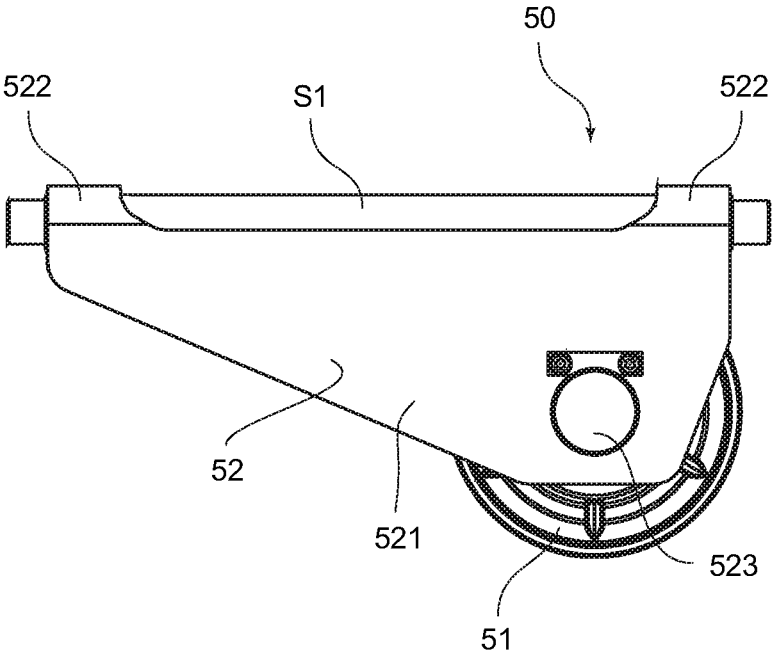
Fig.12
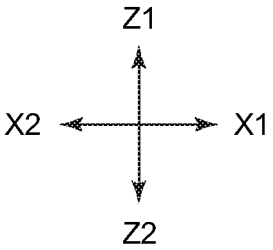

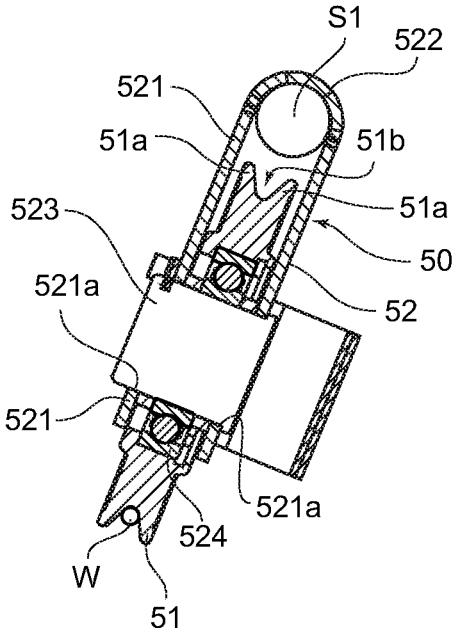
Fig.13
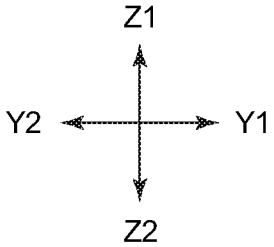

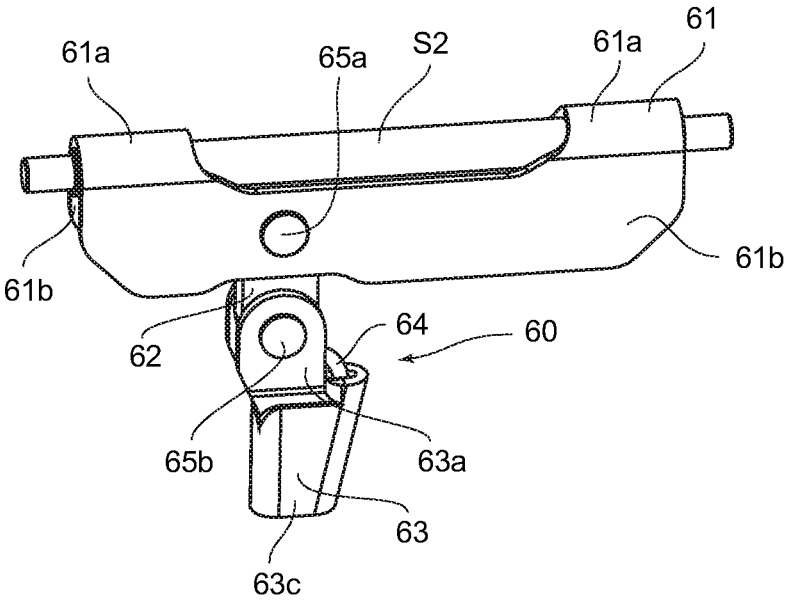
Fig.14
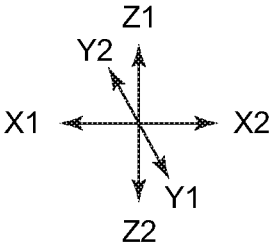

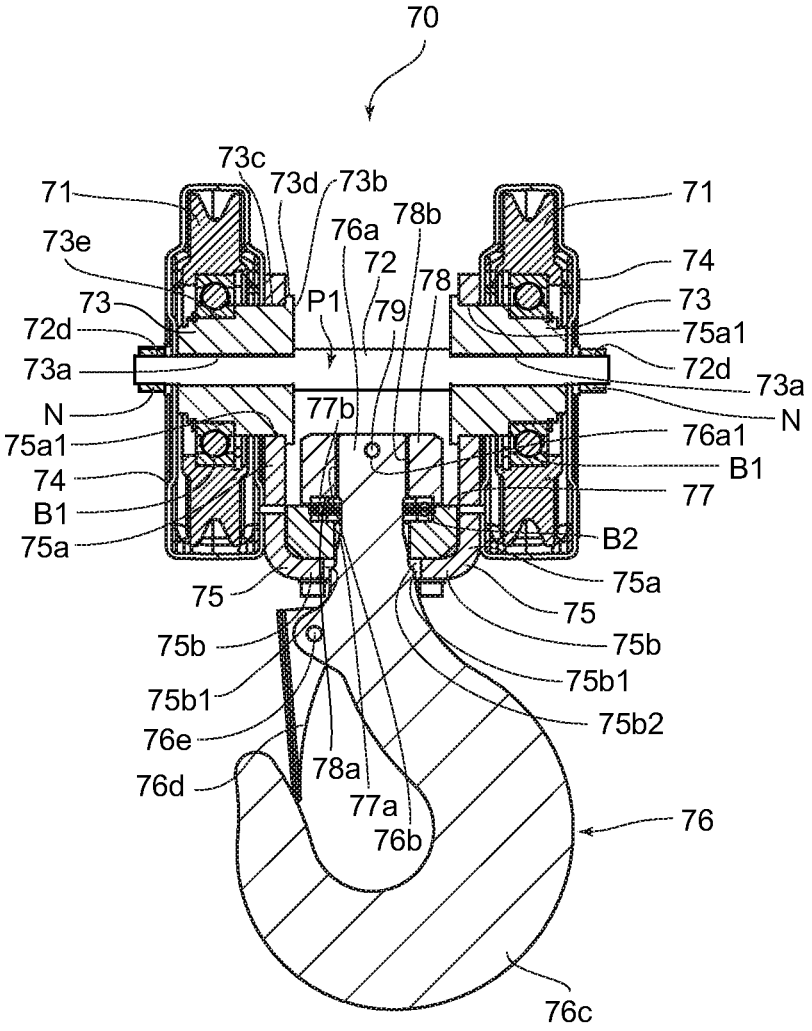
Fig.17
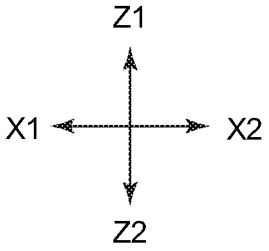

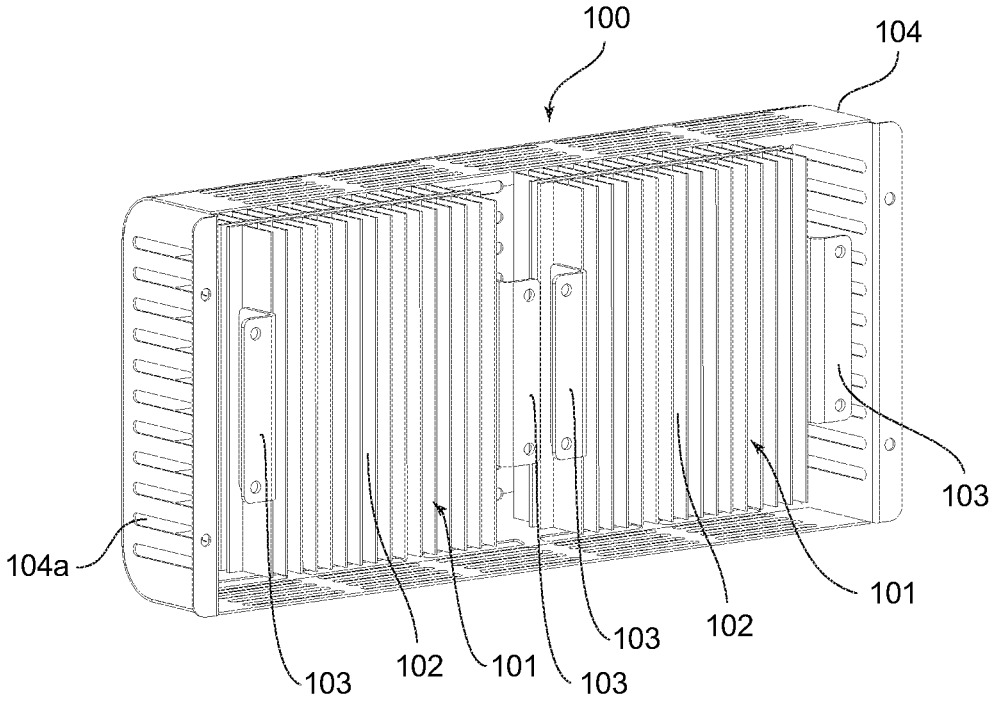
Fig.19
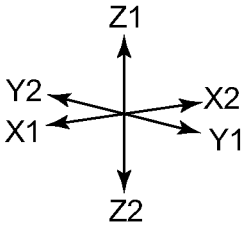

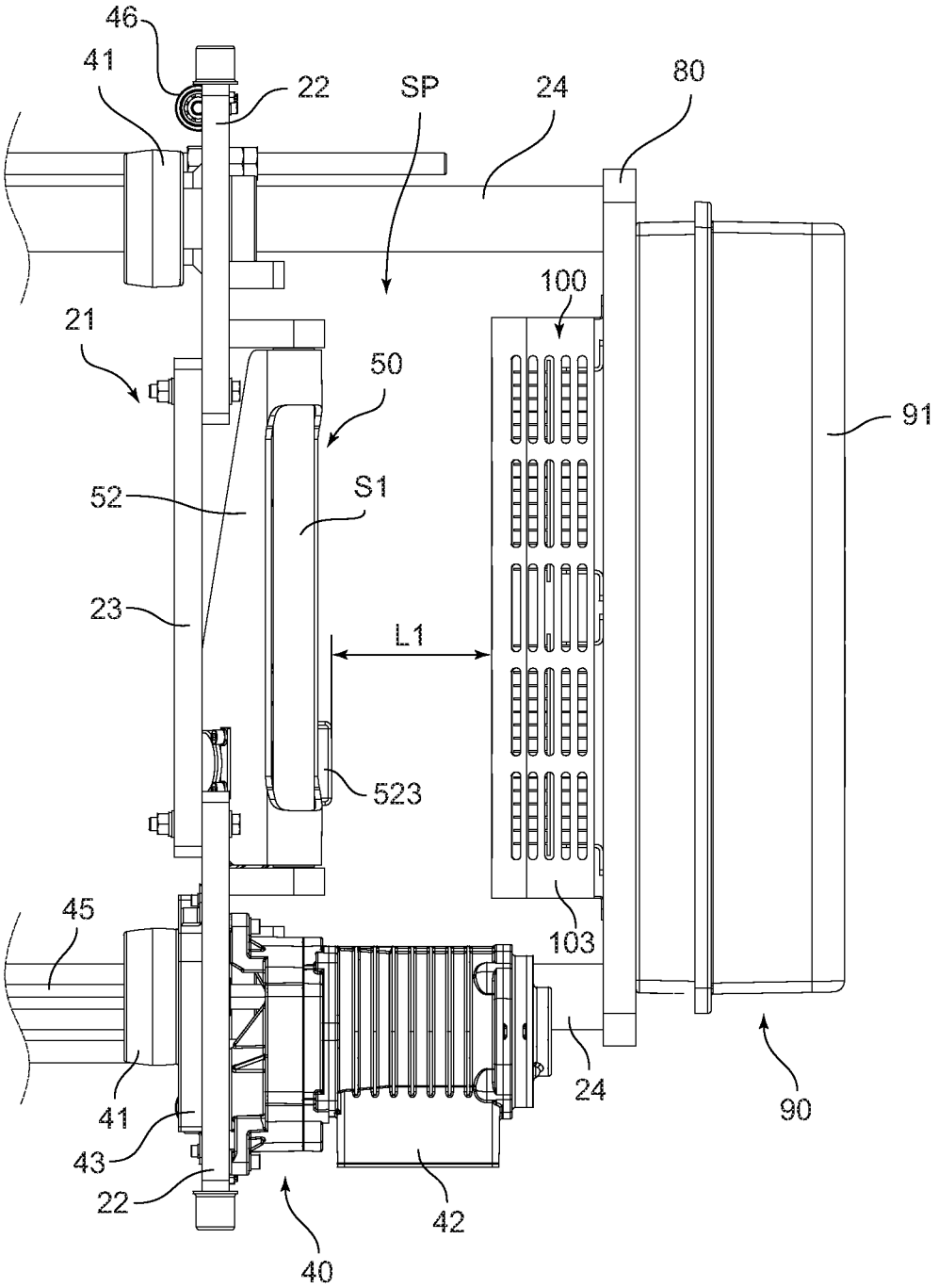
Fig.20
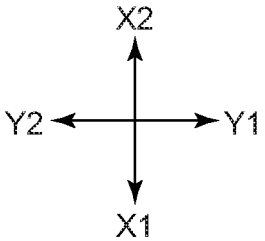

HOOK BLOCK AND ROPE HOIST

This is the U.S. national stage of application No. PCT/JP2015/064822, filed on May, 22, 2015. Priority under 35 U.S.C § 119 (a) and 35 U.S.C. § 365 (b) is claimed from Japanese Application No. 2014-113377, filed May 30, 2014, the disclosure of which is also incorporated herein by reference.

TECHNICAL FIELD

The present invention relates to a hook block and a rope hoist used for an operation of discharging a cargo.

BACKGROUND ART

To move a cargo in the vertical direction and move the suspended cargo along a rail laid on the ceiling side, a rope hoist is generally used. The rope hoist includes a rope drum around which a wire rope is wound, and a hook block is suspended from the wire rope. An example of the rope hoist including the hook block is disclosed in PTL 1.

In the rope hoist disclosed in PTL 1, a hook is provided at a lower pulley 19 (hook block), and the hook is supported by a hook receiving portion formed, for example, by casting. The hook receiving portion is located between a pair of covers in which hook sheaves are built, to which the covers are attached, and which also rotatably supports the pair of hook sheaves.

CITATION LIST

Patent Literature

{PTL 1} JP 2013-511452 (refer to FIG. 1, FIG. 5 and so on)

SUMMARY OF INVENTION

Technical Problem

The lower pulley 19 with a configuration disclosed in PTL 1, however, has a problem of a hook receiving portion being large in size and heavy in weight. More specifically, in PTL 1, the hook receiving portion supporting the hook is formed, for example, by casting or the like, and the hook receiving portion is large in diameter and therefore large in weight. In other words, a portion on the upper side than is the hook is large in weight.

Here, the lower pulley 19 becomes more likely to incline as its position of the center of gravity is higher. When such inclination occurs in the lower pulley 19, the lower pulley 19 becomes more likely to rotate around the rope, particularly in a state of suspending no cargo. More specifically, in a hoisting or lowering state, a pair of pulleys (hook sheaves) rotate in directions different from each other, the action of force due to the rotation rotates the lower pulley 19 in a state of suspending no cargo.

If the lower pulley 19 rotates in a state where the position of the center of gravity of the lower pulley 19 is high and the lower pulley 19 is therefore likely to incline, the behavior of the lower pulley 19 undesirably becomes unstable. The lower pulley 19 when hoisted to the upper limit may collide with other portions. The lower pulley 19 when lowered to the lower limit may collide with the cargo or other portions.

To suppress the inclination of the lower pulley 19, it is conceivable to employ a method of increasing the weight of the hook corresponding to the weight of a hook receiver. However, in this case, the weight of the whole lower pulley 19 increases, thus requiring excessive labor in manufacture and installation. Further, extra material is required according to the increased weight.

Note that to suppress the inclination of the lower pulley 19, it is conceivable to employ a method of lowering the center of gravity by locating the hook at a lower position. However, in a rope hoist called a low-head type is sometimes installed in a building with a low ceiling, and sometimes needs to hoist upward as much as possible a cargo with a large vertical dimension relative to the lifting height. In such a case, the hook located on the lower position undesirably leads to a reduction in lifting height.

Solution to Problem

The present invention has been made based on the above circumstances, and its object is to provide a hook block and a rope hoist capable of achieving at least one of lowering the center of gravity in a suspending state and reducing the weight.

To solve the above problem, according to a first aspect of the present invention, there is provided a hook block suspended via a wire rope and including a hook on which a cargo is hooked, the hook block including: a pair of hook sheaves around which the wire rope is wound; a pair of sheave shaft parts which rotatably support the respective hook sheaves; a coupling shaft which has one side and another side across a center in an axial direction, the one side and the another side being inserted respectively into shaft holes penetrating the pair of sheave shaft parts in the axial direction; a pair of brackets which support the sheave shaft parts fitted in fitting holes of first piece parts, include second piece parts substantially orthogonal to the first piece parts, and are formed with, in a state of facing each other, an insertion hole allowing an upper side of the hook to be inserted therethrough; a bracket fixing member to which each of the pair of brackets is fixed, and which is supported by the second piece parts on a side of the hook opposite to a hook main body part on which the cargo is hooked; and a hook support member which is rotatably arranged to the bracket fixing member on a side opposite to the hook and fixed to an outer periphery on an upper side of the hook.

Further, in another aspect of the present invention, it is preferable in the above invention that: the sheave shaft parts are provided with flange parts which abut on inner wall sides facing each other of the pair of first piece parts and are incapable of being inserted through the shaft holes; the coupling shaft is provided with stepped parts which abut on end surfaces on sides facing each other of the sheave shaft parts, sides closer to end portions in the axial direction than are the stepped parts are inserted into the shaft holes, whereas sides closer to a center in the axial direction than are the stepped parts are provided to be incapable of being inserted through the shaft holes; and in a loaded condition of suspending the cargo from the hook, the abutment of the flange parts on the inner wall sides of the first piece parts and the the abutment of the stepped parts on the end surfaces of the sheave shaft parts prevents the flex so that the first piece parts being getting closer to each other.

Further, in another aspect of the present invention, it is preferable in the above invention that: the bracket fixing member is arranged on a side opposite to the hook out of the second piece; each of the pair of second piece parts is fixed to the bracket fixing member via a fixing means, and the bracket fixing member is formed with a through hole through which the upper side of the hook is inserted; and the hook support member is arranged on a side opposite to the hook out of the bracket fixing member with a shaft bearing interposed therebetween.

Further, another aspect of the present invention is preferably a rope hoist using the hook block according to each of the above-described inventions.

Advantageous Effects of Invention

According to the present invention, it becomes possible to provide a hook block and a rope hoist capable of achieving at least one of lowering the center of gravity in a suspending state and reducing the weight.

BRIEF DESCRIPTION OF DRAWINGS

FIG. 3 is a plan view illustrating the configuration of the rope hoist in FIG. 1 when viewed from the upper side;

FIG. 4 is a bottom view illustrating the configuration of the rope hoist in FIG. 1 when viewed from the lower side;

FIG. 5 is a front view illustrating the configuration of the rope hoist in FIG. 1 when viewed from the front side;

FIG. 6 is a rear view illustrating the configuration of the rope hoist in FIG. 1 when viewed from the rear side;

FIG. 9 is a partial side view of the rope drum for illustrating the vicinity of a rope guide mechanism in the rope hoist in FIG. 1;

FIG. 12 is a partial cross-sectional view illustrating a state of an intermediate sheave body in the rope hoist in FIG. 1 when viewed from the side;

FIG. 13 is a front cross-sectional view illustrating the configuration of the intermediate sheave body in the rope hoist in FIG. 1;

FIG. 14 is a side view illustrating the configuration of a rope fixing member in the rope hoist in FIG. 1;

FIG. 17 is a side cross-sectional view illustrating the configuration of the hook block in the rope hoist in FIG. 1;

FIG. 19 is a perspective view illustrating the internal configuration of a braking resistor in the rope hoist in FIG. 1; and FIG. 20 is a plan view illustrating the appearance of the braking resistor projecting to a space in the rope hoist in FIG. 1.

DESCRIPTION OF EMBODIMENTS

Figure 1:
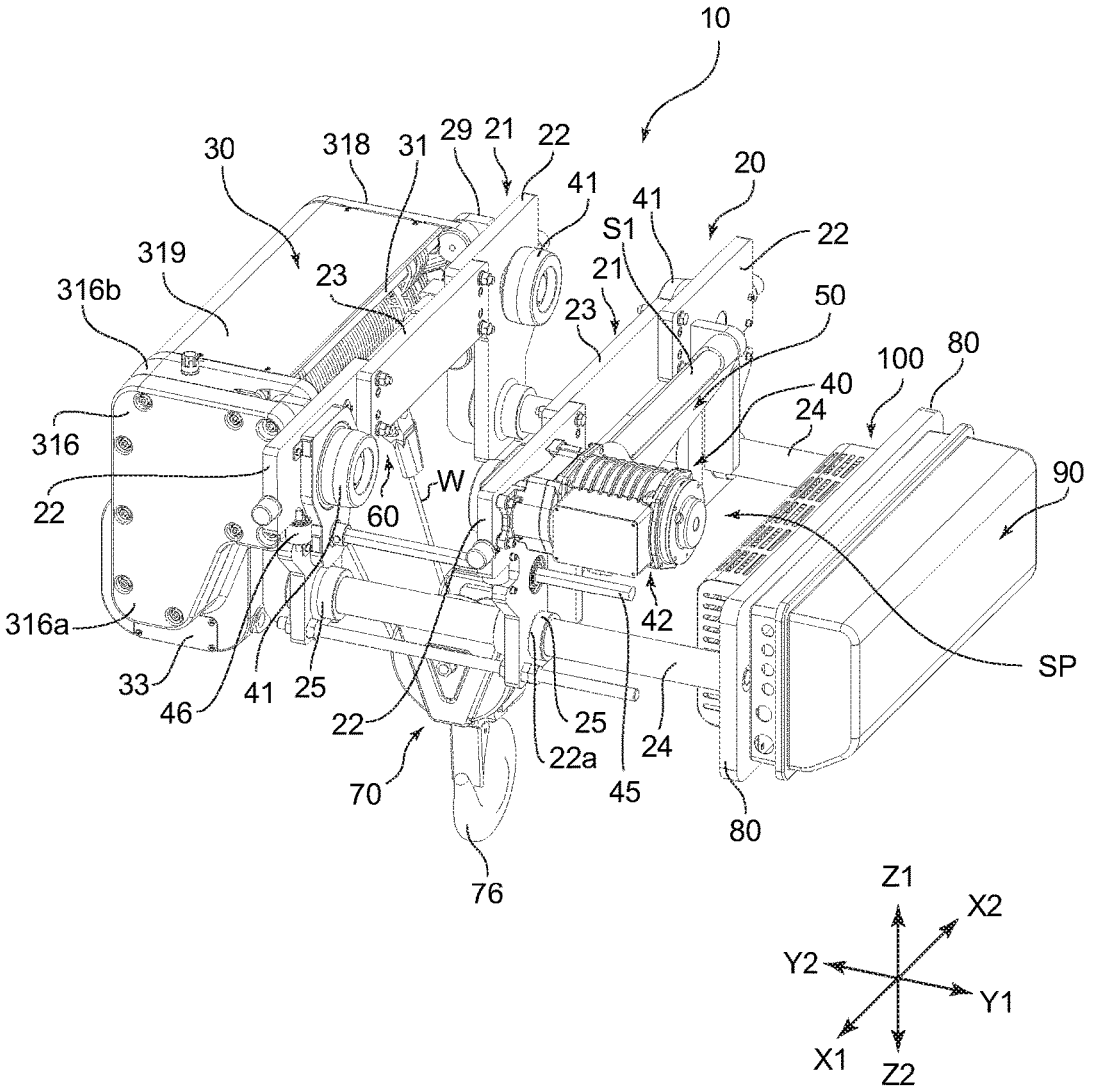
FIG. 1 is a perspective view illustrating the whole configuration of a rope hoist according to an embodiment of the present invention when viewed from the front side.

Hereinafter, a rope hoist 10 using a hook block 70 according to an embodiment of the present invention will be described based on the drawings. Note that in the following description, explanation will be given using an XYZ orthogonal coordinate system as necessary. An X-direction in the XYZ orthogonal coordinate system indicates a direction in which rails extend, an X1 side indicates a side where a drum motor 33 and a traversing motor 42 are located in a longitudinal direction of the rope hoist 10, and an X2 side indicates a side opposite thereto. A Z-direction indicates a vertical direction, a Z1 side indicates an upper side (namely, a side where rails R are located as viewed from the hook block 70), and a Z2 side indicates a lower side opposite thereto. Further, a Y-direction indicates a direction (a width direction of the rail R) orthogonal to the X-direction and the Z-direction, a Y1 side indicates a side where a trolley mechanism 40 is located as viewed from a rope drum mechanism 30, and a Y2 side indicates a side opposite thereto.

<1. Regarding the Whole Configuration of the Rope Hoist 10>

Figure 2:
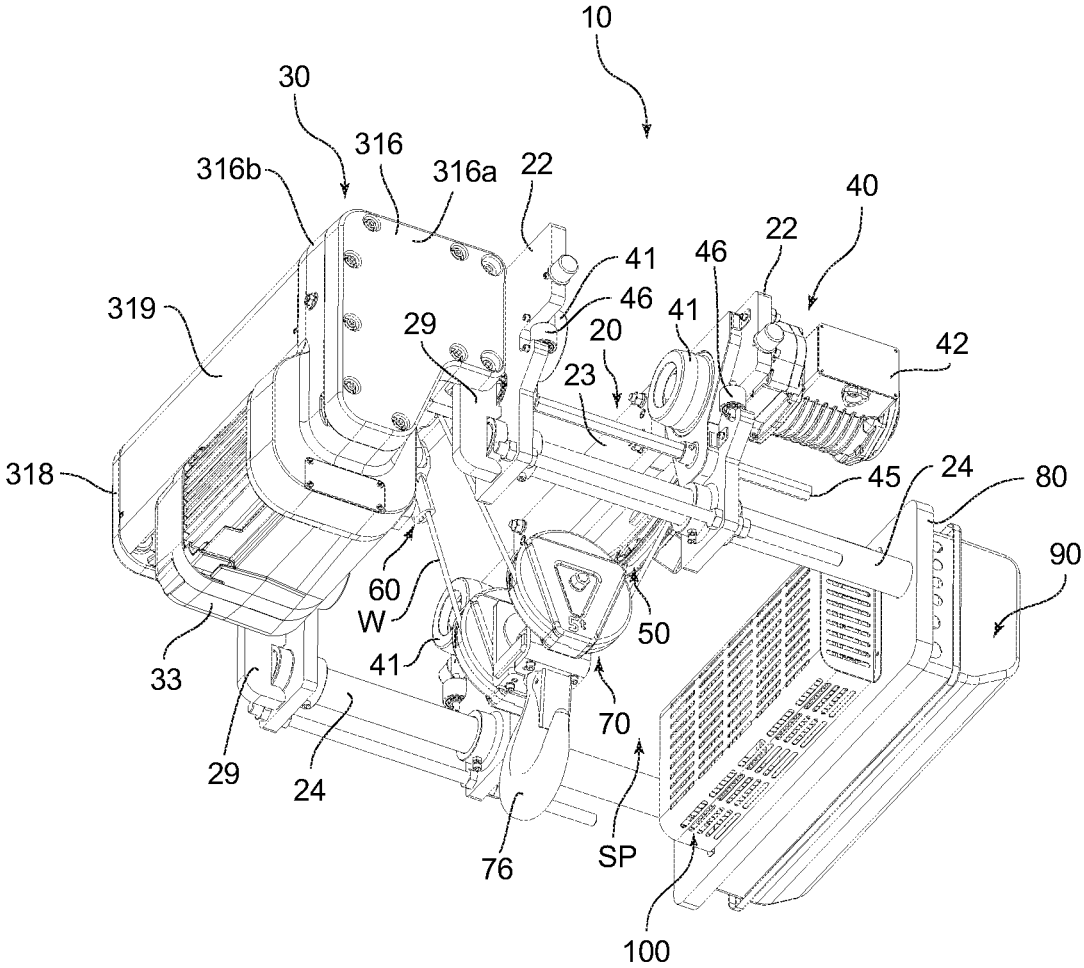
FIG. 2 is a perspective view illustrating the whole configuration of the rope hoist in FIG. 1 when viewed from the rear side.
Figure 2:
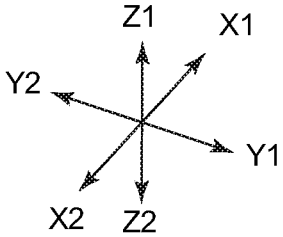

FIG. 1 is a perspective view illustrating the whole configuration of the rope hoist 10 when viewed from the front side. FIG. 2 is a perspective view illustrating the whole configuration of the rope hoist 10 when viewed from the rear side. FIG. 3 is a plan view illustrating the configuration of the rope hoist 10 when viewed from the upper side. FIG. 4 is a bottom view illustrating the configuration of the rope hoist 10 when viewed from the lower side. FIG. 5 is a front view illustrating the configuration of the rope hoist 10 when viewed from the front side. FIG. 6 is a rear view illustrating the configuration of the rope hoist 10 when viewed from the rear side.

As illustrated in FIG. 1 to FIG. 6, the rope hoist 10 includes a frame structure 20, the rope drum mechanism 30, the trolley mechanism 40, an intermediate sheave body 50, a rope fixing member 60, the hook block 70, a counterweight 80, a control unit 90, and a braking resistor 100.

<Regarding the Frame Structure 20>

Figure 7:
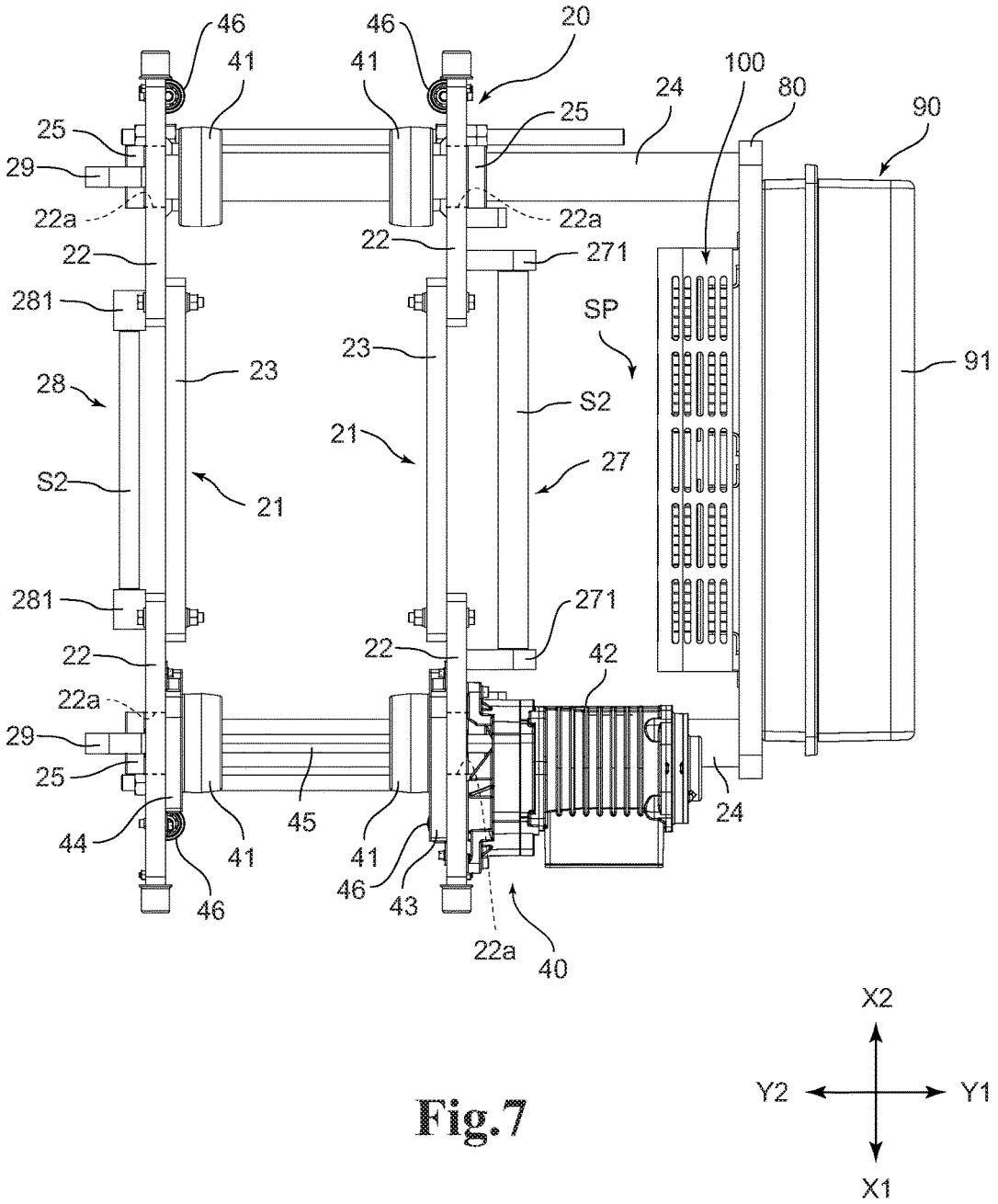
FIG. 7 is a plan view illustrating the configurations of a trolley mechanism and a frame structure in the rope hoist in FIG. 1.

The frame structure 20 will be described first. FIG. 7 is a plan view illustrating the configurations of the frame structure 20 and the trolley mechanism 40. As illustrated in FIG. 7, the frame structure 20 has a pair of front-rear frames 21, coupling bars 24, drum support frames 29, and attachment frames 271, which support the whole of the rope hoist 10.

The front-rear frames 21 are frames extending longitudinally in the extending direction (X-direction) of the rails R, and are provided on the right side and left side (the Y1 side and the Y2 side) across the rails R. The pair of front-rear frames 21 each have two support frames 22 and a coupling frame 23 connecting the support frames 22. To the support frame 22, various members including a wheel 41 are attached. Further, the support frame 22 is provided with an insertion hole 22*a*, a later-described mount member 25 is inserted into the insertion hole 22*a*.

To the support frame 22, the coupling frame 23 is coupled, for example, with a bolt or the like. In the configuration illustrated in FIG. 1 to FIG. 6, the coupling frame 23 is located between the two support frames 22 along the extending direction (X-direction) of the rail R. Note that the coupling frame 23 is located on the rail R side for effective use of a space located between the front-rear frames 21 facing each other in the Y-direction.

Note that the support frame 22 and the coupling frame 23 are provided in a state of not a thin plate but a thick plate so as to be able to support the various members including the wheel 41.

The frame structure 20 also has the coupling bars 24. The coupling bar 24 is a portion extending along the width direction (Y-direction). The coupling bar 24 is inserted into the above-described insertion hole 22*a* via the mount member 25 as illustrated in FIG. 1 and so on, and thereby attached to the support frame 22. Here, on another end side (Y2 side) of the coupling bar 24, the other front-rear frame 21 (corresponding to a drum-side frame) of the pair of front-rear frames 21 is fixed. Further, at a middle portion of the coupling bar 24, the front-rear frame 21 on one side (corresponding to a weight-side frame) is fixed, and the counterweight 80 is fixed on the one end side (Y1 side) of the coupling bar 24.

Further, the mount member 25 is fixedly attached to the insertion hole 22*a*. To the mount member 25, a fixing means such as a screw can be screwed, so that the screwing decides the position of the support frame 22 to the coupling bar 24. However, in this embodiment, the drum support frame 29 lies over an opening on the other end side (Y2 side) of the mount member 25 located on the other end side (Y2 side) in the width direction, whereby the coupling bar 24 bumps into the drum support frame 29 to thereby decide the position of the front-rear frame 21 on the other side (Y2 side) with respect to the coupling bar 24. However, loosening a fastening means such as a bolt makes it possible to freely change the front-rear frame 21 on the one side (Y1 side) with respect to the coupling bar 24. Thus, when mounting the rope hoist 10, the front-rear frame 21 on the one side (Y1 side) can be separated from the front-rear frame 21 on the other side (Y2 side).

Note that in the configuration illustrated in FIG. 7, to the frame structure 20, an intermediate sheave support part 27 and a terminal support part 28 are attached. The intermediate sheave support part 27 is a portion that supports a suspender shaft S1 supporting the later-described intermediate sheave body 50, and is arranged on the one side (Y1 side) in the width direction (Y-direction) of the frame structure 20 in the configuration illustrated in FIG. 7 and so on. To support the above-described suspender shaft S1, the intermediate sheave support part 27 has a pair of attachment frames 271, and the attachment frames 271 are attached to the pair of support frames 22 separated in the longitudinal direction (X-direction), respectively.

Because the intermediate sheave support part 27 is arranged on the one side (Y1 side) in the width direction (Y-direction) of the frame structure 20 as described above, the attachment frames 271 project toward the one side (Y1 side) in the width direction (Y-direction). Therefore, a space SP between the frame structure 20 and the later-described counterweight 80 is narrowed by an amount corresponding to the existence of the attachment frames 271 and the intermediate sheave body 50.

Besides, the terminal support part 28 is a portion that supports a terminal support shaft S2 supporting the later-described rope fixing member 60, and is arranged on the other side (Y2 side) in the width direction (Y-direction) of the frame structure 20 in the configuration illustrated in FIG. 7 and so on. The terminal support part 28 has a pair of shaft holding parts 281, and the shaft holding parts 281 are attached to the pair of support frames 22 separated in the longitudinal direction (X-direction), respectively.

Further, the frame structure 20 is provided with the drum support frame 29 projecting toward the other side (Y2 side) in the width direction (Y-direction). A pair of the drum support frames 29 are provided, and the drum support frames 29 are attached to the support frames 22 separated in the longitudinal direction (X-direction), respectively. To the pair of drum support frames 29, one end side and the other end side of the rope drum mechanism 30 described next are fixed, respectively.

<3. Regarding the Rope Drum Mechanism 30>

Next, the rope drum mechanism 30 will be described. As illustrated in FIG. 1 to FIG. 6 and so on, the rope drum mechanism 30 has a rope drum 31, a rope guide mechanism 32, the drum motor 33, and a reduction mechanism 34 as main components.

Figure 8:
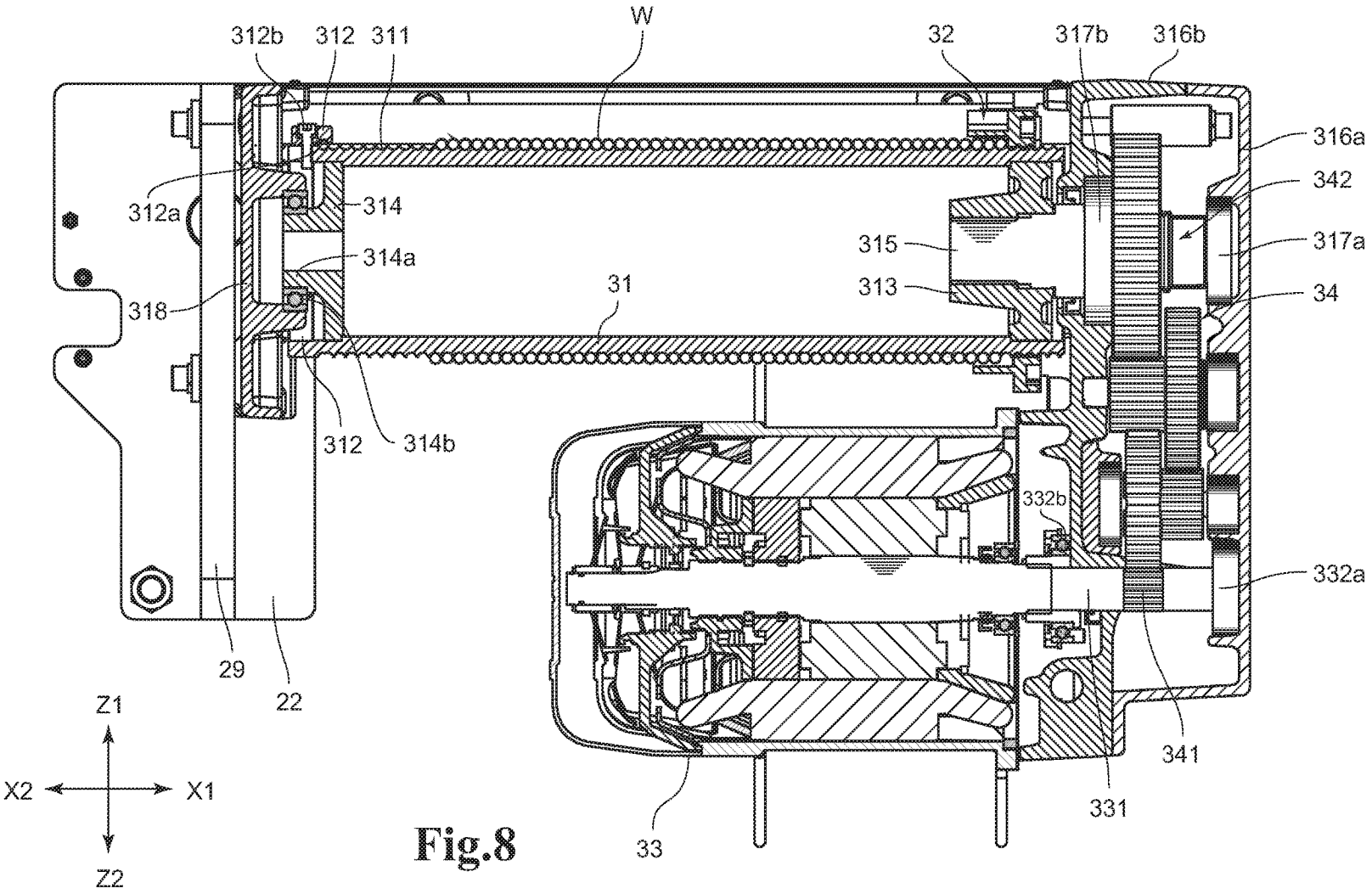
FIG. 8 is a side view illustrating the configuration of a rope drum in the rope hoist in FIG. 1, and illustrating the vicinity of the rope drum and the vicinity of a drum motor in a cross section.

FIG. 8 is a side view illustrating the configuration of the rope drum 31, and illustrating the vicinity of the rope drum 31 and the vicinity of the drum motor 33 in a cross section. As illustrated in FIG. 8, the rope drum 31 is a drum-shaped member around which a wire rope W is wound, and is formed, on the outer peripheral side, with a spiral groove 311 in a recessed groove shape in which the wire rope W is fitted. The spiral groove 311 is formed in a spiral shape on the outer periphery of the rope drum 31, and formed corresponding to the radius of the wire rope W. Further, the spiral groove 311 is formed such that the wire rope W is lined up thereon in a row in a not-overlapping state (in a single layer state).

Note that to the other end side (rear side; X2 side) of the rope drum 31, a rope pressing metal fitting 312 for fixing the one end side of the wire rope W is attached. The rope pressing metal fitting 312 includes a recessed part 312*a* where the wire rope W is located, and a screw 312*b* being a fastening means is firmly screwed into the rope drum 31 with the wire rope W located in the recessed part 312*a*. Thus, the one end side of the wire rope W is fixed to the rope drum 31.

Further, to the one end side (front side; X1 side) and the other end side (rear side; X2 side) of the rope drum 31, rotatable support parts 313, 314 are attached, respectively. As illustrated in FIG. 8, to the rotatable support part 313 on the one end side (front side; X1 side), a drum rotation shaft 315 is coupled, for example, by spline coupling. The drum rotation shaft 315 is attached to a pair of gear housings 316*a*, 316*b* via bearings 317*a*, 317*b* as shaft bearings. Note that in this embodiment, the gear housings 316*a*, 316*b* are formed in different shapes, and the bearings 317*a*, 317*b* are also of different types, but the gear housings 316*a*, 316*b* or the bearings 317*a*, 317*b* may be made common.

Besides, to an annular projecting part 314*a* on the center side in the radial direction of the rotatable support part 314 on the other end side (rear side; X2 side) of the rope drum 31, a bearing 314*b* is attached, and the outer peripheral side of the bearing 314*b* is attached to an attachment frame 318. Thus, the other end side of the rope drum 31 is also rotatably supported. Note that as illustrated in FIG. 1 and so on, the rope drum 31 is covered, on the upper side, with a cover frame 319.

Figure 10:
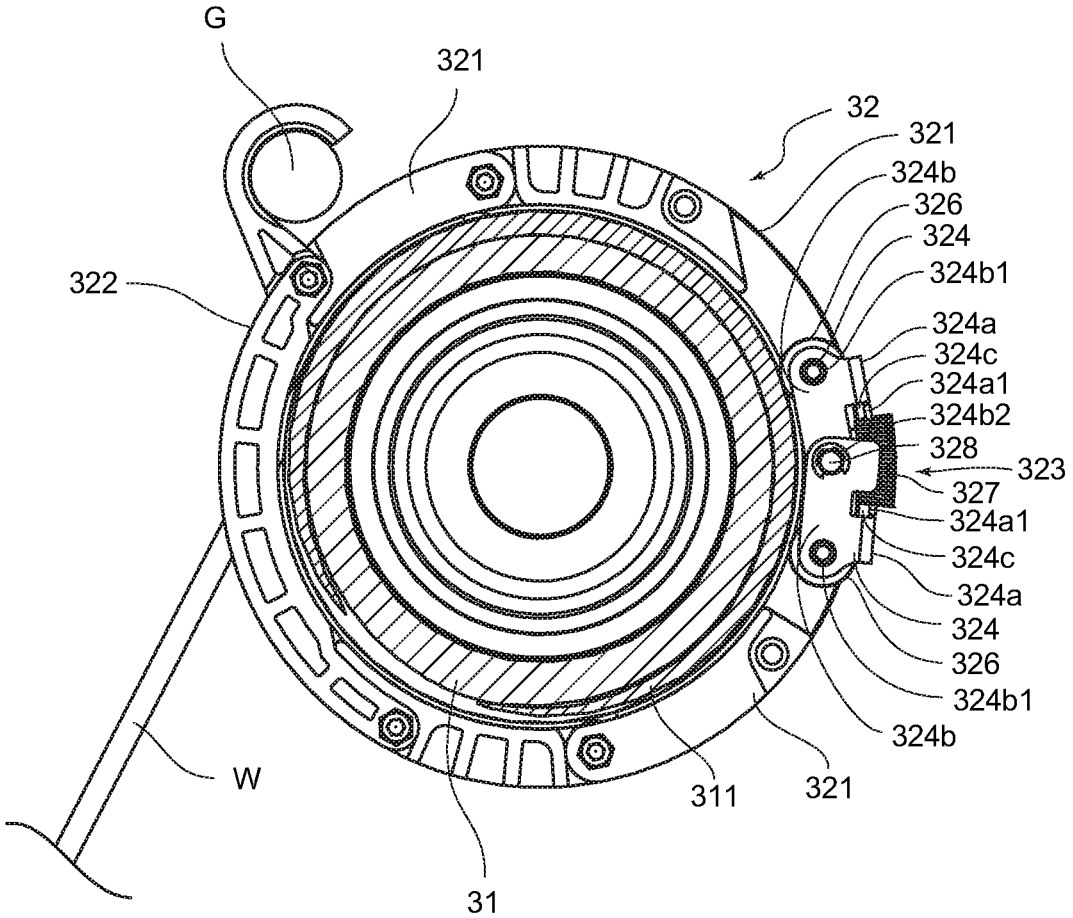
FIG. 10 is a rear view illustrating a cross section of the rope drum in the rope hoist in FIG. 1 and illustrating the configuration of the rope guide mechanism.
Figure 10:
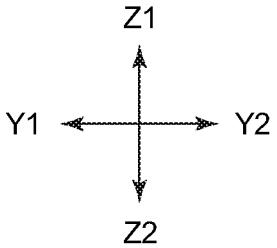
Figure 11:
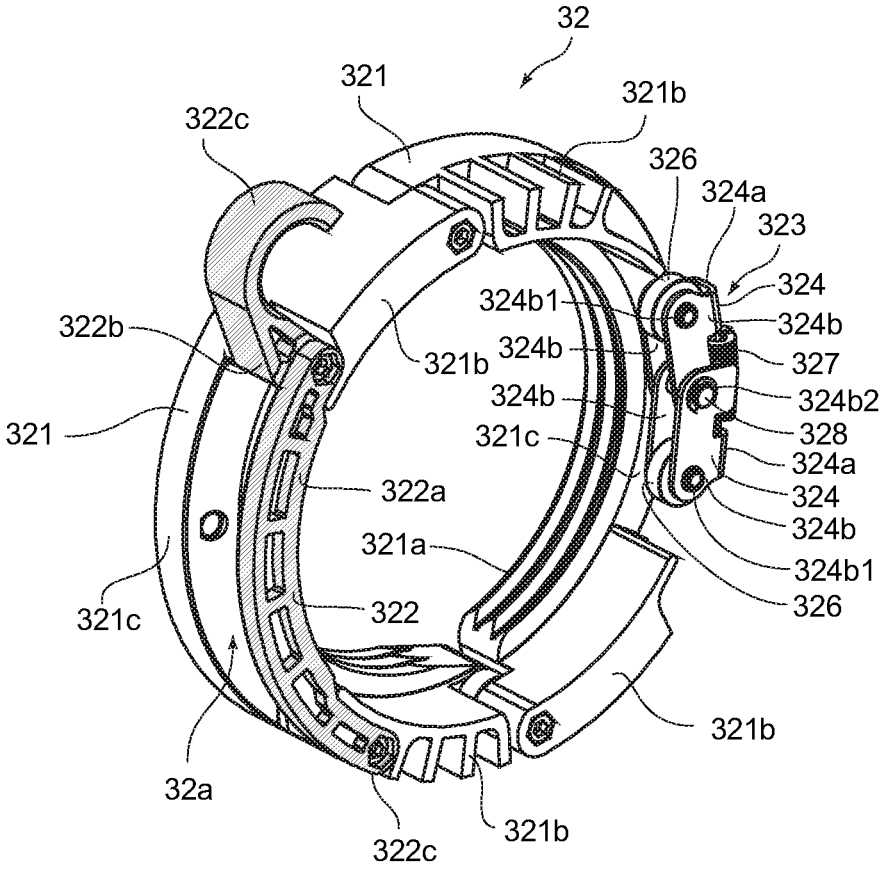
FIG. 11 is a perspective view illustrating the configuration of the rope guide mechanism in the rope hoist in FIG. 1.
Figure 11:
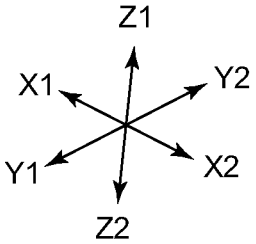

FIG. 9 is a partial side view of the rope drum 31 for illustrating the vicinity of the rope guide mechanism 32. FIG. 10 is a rear view illustrating a cross section of the rope drum 31 and illustrating the configuration of the rope guide mechanism 32. FIG. 11 is a perspective view illustrating the configuration of the rope guide mechanism 32. As illustrated in FIG. 9 and FIG. 10, the rope guide mechanism 32 is a member that moves in a front-rear direction (X-direction) while being guided by a support shaft G with the rotation of the rope drum 31. Note that the support shaft G is supported by the above-described gear housing 316*a* and the attachment frame 318 and can satisfactorily guide the slide of the rope guide mechanism 32. Note that a plurality of, such as, three support shafts G are provided. Besides, the plurality of support shafts G are attached to the gear housing 316*a* and the attachment frame 318, thereby constituting a drum support structure that supports the rope drum 31.

As illustrated in FIG. 9 to FIG. 11, the rope guide mechanism 32 has a ring-shaped member 321, a guide member 322, and a guide roller body 323 as main components.

As illustrated in FIG. 11, the ring-shaped member 321 is a member formed into a ring shape by combining a plurality of, such as, two circumferential members and the guide member 322. On the inner peripheral side of the ring-shaped member 321, a spiral projecting part 321*a* is provided which is fitted in the spiral groove 311 of the rope drum 31. The spiral projecting part 321*a* is provided in a circumferential shape forming a spiral. However, to prevent interference with the rope drum 31, the spiral projecting part 321*a* is provided on the inner peripheral side of the ring-shaped member 321 to face a non-wound side of the wire rope W.

Besides, as illustrated in FIG. 11, both end sides in the circumferential direction of the ring-shaped member 321 are provided widely by providing projecting parts 321*b* projecting to the other side (X2 side) in the X-direction. However, a portion located between the projecting parts 321*b* on both ends in the circumferential direction is a narrow-width part 321*c* with a narrow width. Further, to the narrow-width part 321*c* of one ring-shaped member 321, the guide member 322 is fixed. Thus, between the ring-shaped member 321 and the guide member 322, a guide opening 32*a* that guides the wire rope W is provided. Note that the guide opening 32*a* is an opening portion for leading the wire rope W to be wound around the rope drum 31 while guiding the wire rope W to the spiral groove 311, and is provided in a long-hole opening shape.

Further, as illustrated in FIG. 11, the guide member 322 is attached to the narrow-width part 321*c* of the ring-shaped member 321 via a screw or the like. The guide member 322 is provided with an arc-shaped part 322*a*, coupling parts 322*b*, and a guide part 322*c*. The arc-shaped part 322*a* is provided in an arc shape to follow the outer periphery of the rope drum 31. Besides, the coupling parts 322*b* are portions that are located on both end sides of the arc-shaped part 322*a* and abut on the narrow-width part 321*c*. To be able to abut on the narrow-width part 321*c*, the coupling parts 322*b* are provided larger in dimension in the width direction (X-direction) than the arc-shaped part 322*a*.

Further, the guide part 322*c* is provided in a curved hook shape, and is in contact with the support shaft G at a recessed part 321*c*1 being the inside of the curve. The support shaft G is fitted in the recessed part 321*c*1 and thereby makes the rope guide mechanism 32 satisfactorily movable in the front-rear direction (X-direction).

Besides, as illustrated in FIG. 10 and FIG. 11, the guide roller body 323 is attached to the narrow-width part 321*c* of the other ring-shaped member 321. The guide roller body 323 has a pair of roller supporters 324, rollers 326, a biasing spring 327, and an attaching shaft 328. The rollers 326 press the wire rope W fitted in the spiral groove 311 after passing through the guide opening 32*a*, and thereby prevent the wire rope W from coming off the spiral groove 311.

The roller supporters 324 of the guide roller body 323 each have a base part 324*a* and a pair of opposing wall parts 324*b*, which form an almost U-shape. However, one of the pair of roller supporters 324 is provided wider than the other of the roller supporters 324, so that the other roller supporter 324 can be located inside the one roller supporter 324. The two roller supporters 324 are coupled together via the attaching-shaft 328.

On the base parts 324*a*, end portion sides of the biasing spring 327 are supported, respectively. Therefore, the length of the base part 324*a* is provided shorter than the length of the opposing wall parts 324*b* so that the biasing spring 327 can be located between the two base parts 324*a*, thereby forming opening 324*c* between the two base parts 324*a*.

Further, from the base parts 324*a*, rod parts 324*a*1 project toward the opening 324*c*, and the rod parts 324*a*1 are inserted into air-core portions of the biasing spring 327. Thus, the biasing spring 327 is supported between the two base parts 324*a*. Note that the biasing spring 327 is a compression spring, and applies biasing force to the rollers 326 in a direction of pressing the wire rope W against the spiral groove 311.

Besides, the opposing wall parts 324*b* are provided with shaft holes 324*b*1, and the support shaft for the roller 326 is rotatably supported by the shaft holes 324*b*1. The opposing wall parts 324*b* are also provided with coupling holes 324*b*2 for coupling the two roller supporters 324. The coupling holes 324*b*2 of the roller supporter 324 located on the outside and the coupling holes 324*b*2 of the roller supporter 324 located on the inside are aligned, and the attaching shaft 328 is inserted through the coupling holes 324*b*2. Further, at the narrow-width part 321*c* of the other ring-shaped member 321, the attaching shaft 328 is coupled to the ring-shaped member 321. Thus, the roller supporters 324 are attached to the ring-shaped member 321 via the attaching shaft 328.

The above configuration of the rope guide mechanism 32 enables the wire rope W to fit into the spiral groove 311 of the rope drum 31 via the guide opening 32*a*. It is also possible to lead the wire rope W out of the spiral groove 311 to the outside via the guide opening 32*a*. In this event, the provision of the guide roller body 323 on the opposite side in the circumferential direction to the guide opening 32*a* prevents the wire rope W from coming off the spiral groove 311.

Besides, as illustrated in FIG. 8, to the gear housings 316*a*, 316*b*, the drum motor 33 is attached. The drum motor 33 applies driving force of rotating the rope drum 31. To an output shaft 331 of the drum motor 33, a pinion gear 341 constituting the reduction mechanism 34 is attached, and driving force of the pinion gear 341 is transmitted through a gear train wheel 342 to the drum rotation shaft 315. Note that the output shaft 331 is also attached to the gear housings 316*a*, 316*b* via bearings 332*a*, 332*b* as shaft bearings. Hereinafter, when the gear housings 316*a*, 316*b* are collectively described, they are called simply as a gear housing 316.

<4. Regarding the Trolley Mechanism 40>

Next, the trolley mechanism 40 will be described. As illustrated in FIG. 1 to FIG. 6 and so on, the rope hoist 10 has the trolley mechanism 40. The trolley mechanism 40 has the wheels 41 attached to the support frames 22 of the frame structure 20, the traversing motor 42, gear mechanism parts 43, 44, a drive shaft 45, and guide rollers 46. Note that the frame structure 20 may also be the one constituting the trolley mechanism 40. Two wheels 41 each on one side and the other side of the rails R (four in total) are provided. The wheels 41 are mounted on flange parts R1 of the rails R.

As illustrated in FIG. 7, to the support frame 22 located on the one side (Y1 side) in the width direction, the traversing motor 42 that generates driving force is attached. The traversing motor 42 applies the driving force to the two wheels 41 located on the one side (X1 side) in the longitudinal direction (X-direction). In more detail, the driving force from the output shaft of the traversing motor 42 is transmitted to the drive shaft 45 through a gear train wheel (not illustrated) located inside the gear mechanism part 43.

The drive shaft 45 is provided along the width direction (Y-direction), and its other end side (Y2 side) in the width direction (Y-direction) is connected to the gear mechanism part 44. Also inside the gear mechanism part 44, a gear train wheel (not illustrated) is provided, and the driving force is transmitted through the gear train wheel to the wheels 41 on the other end side (Y2 side). Thus, the two wheels 41 are simultaneously rotated to enable stable traveling of the rope hoist 10.

Note that to the support frames 22, the guide rollers 46 are attached respectively. When the traversing motor 42 is driven to move the rope hoist 10 along the rails R, the rope hoist 10 meanders in some cases. To prevent such meander, the guide rollers 46 are provided in the vicinity of the respective wheels 41, and the guide rollers 46 are in contact with the flange parts R1 of the rails R. This stabilizes the traveling of the rope hoist 10. The guide rollers 46 are located on a slightly lower side than are the wheels 41 to as to come into contact with the flange parts R1, and are provided on an outer side in the longitudinal direction (X-direction) than are the wheels 41.

<5. Regarding the Intermediate Sheave Body 50>

Next, the intermediate sheave body 50 will be described. As illustrated in FIG. 3 and FIG. 6, the intermediate sheave body 50 is provided on a side more rear (X2 side) than is the traversing motor 42. FIG. 12 is a partial cross-sectional view illustrating a state of the intermediate sheave body 50 as viewed from the side. Besides, FIG. 13 is a front cross-sectional view illustrating the configuration of the intermediate sheave body 50.

As illustrated in FIG. 12, the intermediate sheave body 50 includes an intermediate sheave 51 (pulley) around which the wire rope W is wound, and the intermediate sheave 51 has a recessed groove 51*b* surrounded by a flange 51*a*. Further, the intermediate sheave 51 is arranged in a direction to be parallel with the rails R. The intermediate sheave body 50 enables relay of the wire rope W between adjacent hook sheaves 71 (refer to FIG. 16, FIG. 17) of the later-described hook block 70. The intermediate sheave body 50 is attached to the suspender shaft S1. The intermediate sheave body 50 includes a suspending metal fitting 52, and the suspending metal fitting 52 is supported on the suspender shaft S1.

As illustrated in FIG. 11 and FIG. 12, the suspending metal fitting 52 has a pair of plate portions 521 facing each other, and coupling portions 522 that couple the pair of plate portions 521 are provided on both end sides and an upper side of the plate portions 521. As illustrated in FIG. 12, the coupling portions 522 are provided in a shape curved to surround the suspender shaft S1, and the coupling portions 522 swing (turn) in contact with the suspender shaft S1 and thereby enable the intermediate sheave body 50 to swing (turn over). Note that a portion between the pair of coupling portions 522 is a punched portion P.

Between the pair of plate portions 521, the intermediate sheave 51 is rotatably supported. More specifically, the pair of plate portions 521 are provided with rotatable support holes 521*a* respectively, and to the rotatable support holes 521*a*, a support shaft 523 is attached. On the outer peripheral side of the support shaft 523 and between the pair of plate portions 521, a bearing 524 as a shaft bearing is attached. To the outer peripheral side of the bearing 524, the intermediate sheave 51 is attached. Thus, the intermediate sheave 51 is provided rotatably with respect to the plate portions 521.

<6. Regarding the Rope Fixing Member 60>

Figure 15:
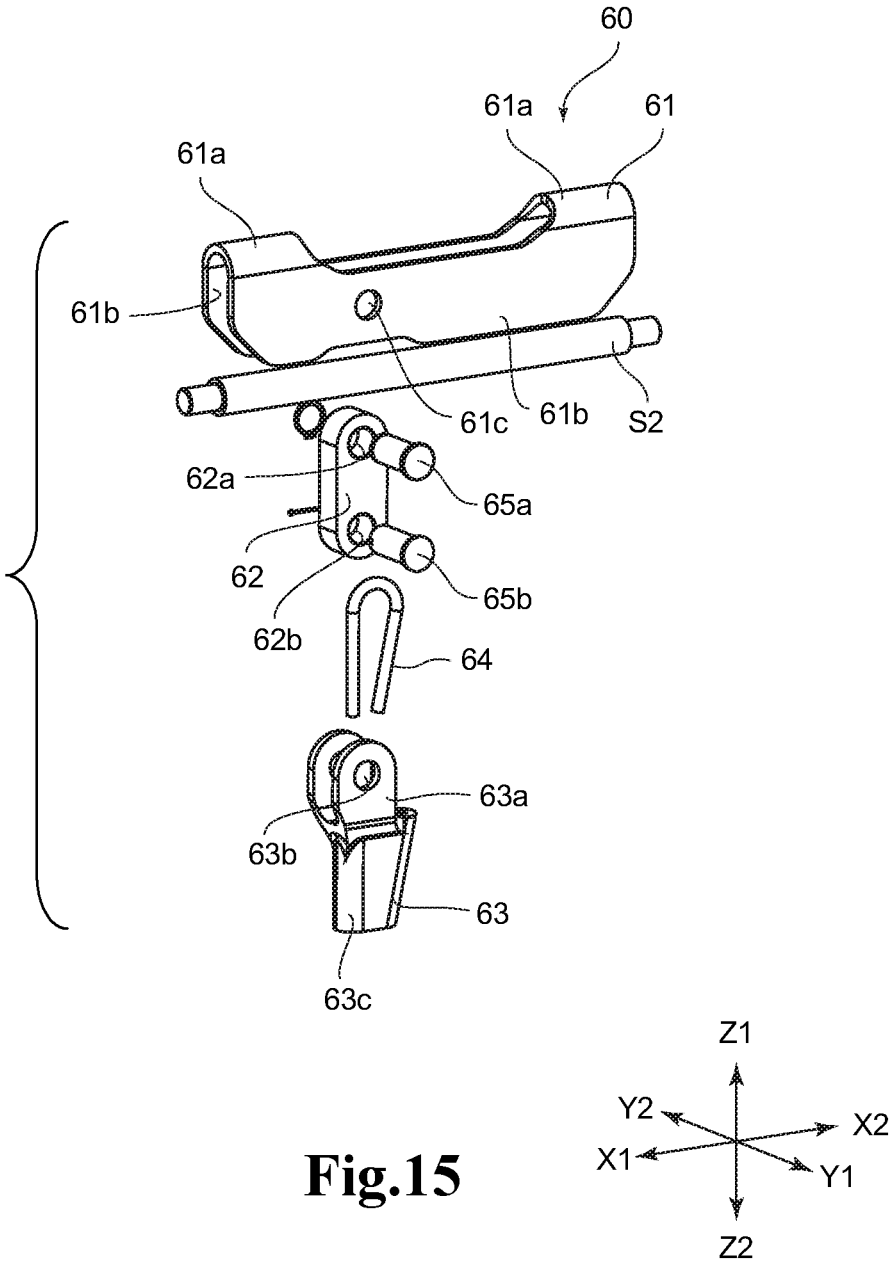
FIG. 15 is an exploded perspective view illustrating the configuration of the rope fixing member in the rope hoist in FIG. 1.

Besides, as illustrated in FIG. 1 to FIG. 4 and so on, to retain the one end side of the wire rope W, the rope fixing member 60 is provided. The rope fixing member 60 is attached to the above-described terminal support shaft S2. FIG. 14 is a side view illustrating the configuration of the rope fixing member 60. FIG. 15 is an exploded perspective view illustrating the configuration of the rope fixing member 60. As illustrated in FIG. 14 and FIG. 15, the rope fixing member 60 has a horizontal turn metal fitting 61, a connecting member 62, a vertical turn metal fitting 63, and a wedge member 64 as main components. The horizontal turn metal fitting 61 is provided having a front shape in an almost U-shape, and curved portions 61*a* in an almost U shape are in contact with the terminal support shaft S2, and plate portions 61*b* continuing to the curved portions 61*a* face to each other. The slide between the curved portions 61*a* and the terminal support shaft S2 enables the horizontal turn metal fitting 61 to swing in a YZ plane.

The pair of plate portions 61*b* of the horizontal turn metal fitting 61 are provided with shaft holes 61*c*. Further, between the pair of plate portions 61*b*, the connecting member 62 is arranged. Further, on an upper side of the connecting member 62, a through hole 62*a* is provided into which a fixing shaft 65*a* is to be inserted. Therefore, the shaft holes 61*c* and the through hole 62*a* are aligned and the fixing shaft 65*a* is inserted into them, whereby the connecting member 62 is provided to be swingable within a plane including the extending direction of the rails R via the fixing shaft 65*a*.

Further, also on an upper side of the vertical turn metal fitting 63, a pair of plate portions 63*a* are provided, and a lower side of the connecting member 62 is arranged between the pair of plate portions 63*a*. Here, the pair of plate portions 63*a* are provided with shaft holes 63*b* respectively. Further, also on a lower side of the connecting member 62, a through hole 62*b* is provided. Therefore, the shaft holes 63*b* and the through hole 62*b* are aligned and a fixing shaft 65*b* is inserted into them, whereby the vertical turn metal fitting 63 is provided to be swingable within a plane including the extending direction of the rails R via the connecting member 62.

Further, on a lower side of the vertical turn metal fitting 63, a rope retaining part 63*c* is provided. The rope retaining part 63*c* is provided such that the upper side and the lower side of a quadrangular pyramid columnar shape are opened to allow the wire rope W and the later-described wedge member 64 to be inserted thereinto from the upper side and the lower side. Further, the rope retaining part 63*c* is provided such that its cross-sectional area becomes smaller downward.

As illustrated in FIG. 14 and FIG. 15, inside the rope retaining part 63*c*, the wedge member 64 is arranged. The wedge member 64, in the configuration illustrated in FIG. 15, is formed by curving a rod-shaped member such as a steel bar (wire material) with a predetermined diameter. The wedge member 64 is provided such that a curved portion has a large diameter on the upper side, and rod-shaped members become closer to each other toward the lower side. Further, on the outer peripheral side of the wedge member 64, the wire rope W is provided to go around. Therefore, the wire rope W is sandwiched between the wedge member 64 and the inner wall of the rope retaining part 63*c*, and the other end side of the wire rope W is fixed by wedging. In particular, when a large load acts on the wire rope W, the wedge member 64 tries to move downward. In this case, the wire rope W is held by large holding force between the wedge member 64 and the inner wall of the rope retaining part 63*c*. This restricts downward movement of the wire rope W.

Note that the most terminal side of the wire rope W is fixed to a middle portion of the wire rope W by a not-illustrated fixing metal fitting below the rope retaining part 63*c*.

<7. Regarding the Hook Block 70>

Next, the hook block 70 will be described. As illustrated in FIG. 1 to FIG. 6, the rope hoist 10 includes the hook block 70. The hook block 70 is suspended at a middle portion between the one end side and the other end side of the wire rope W.

Figure 16:
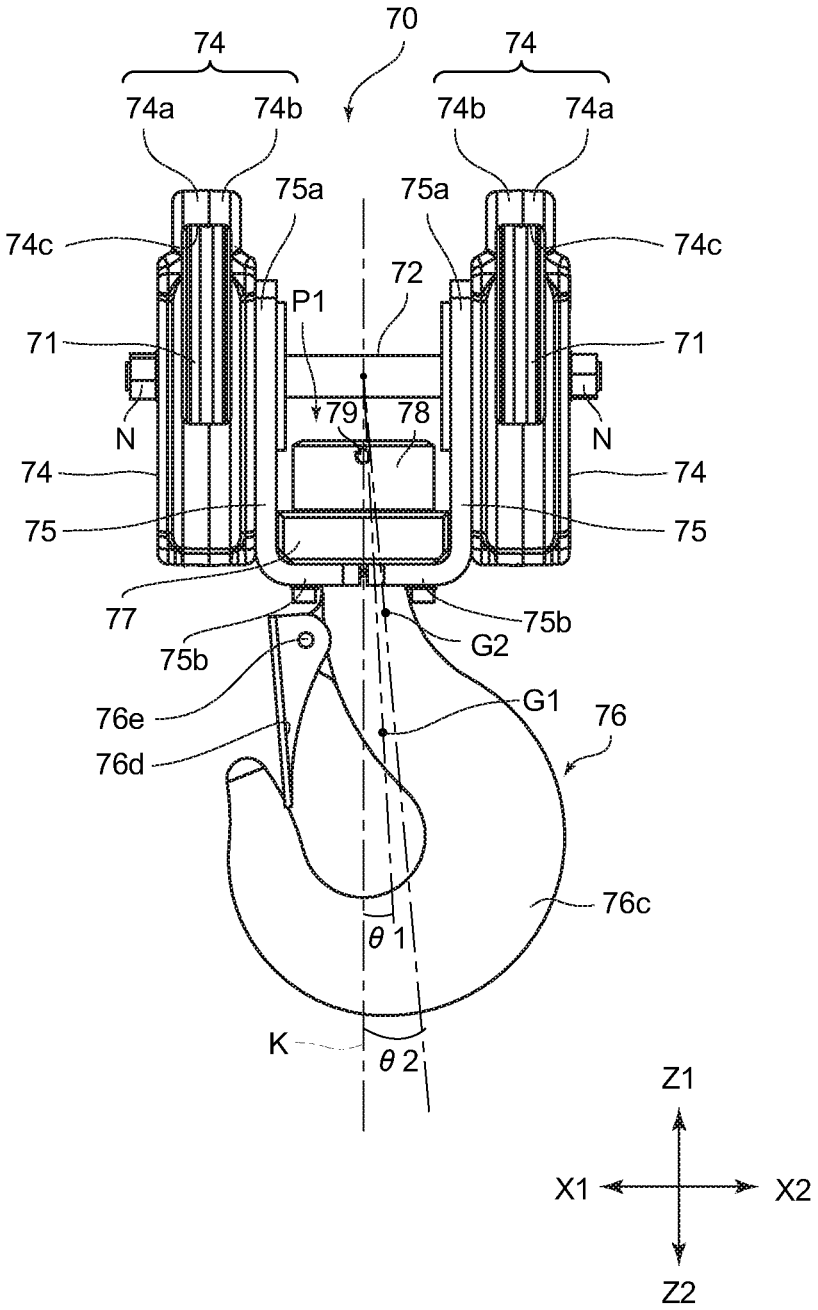
FIG. 16 is a side view illustrating the configuration of a hook block in the rope hoist in FIG. 1.
Figure 18:
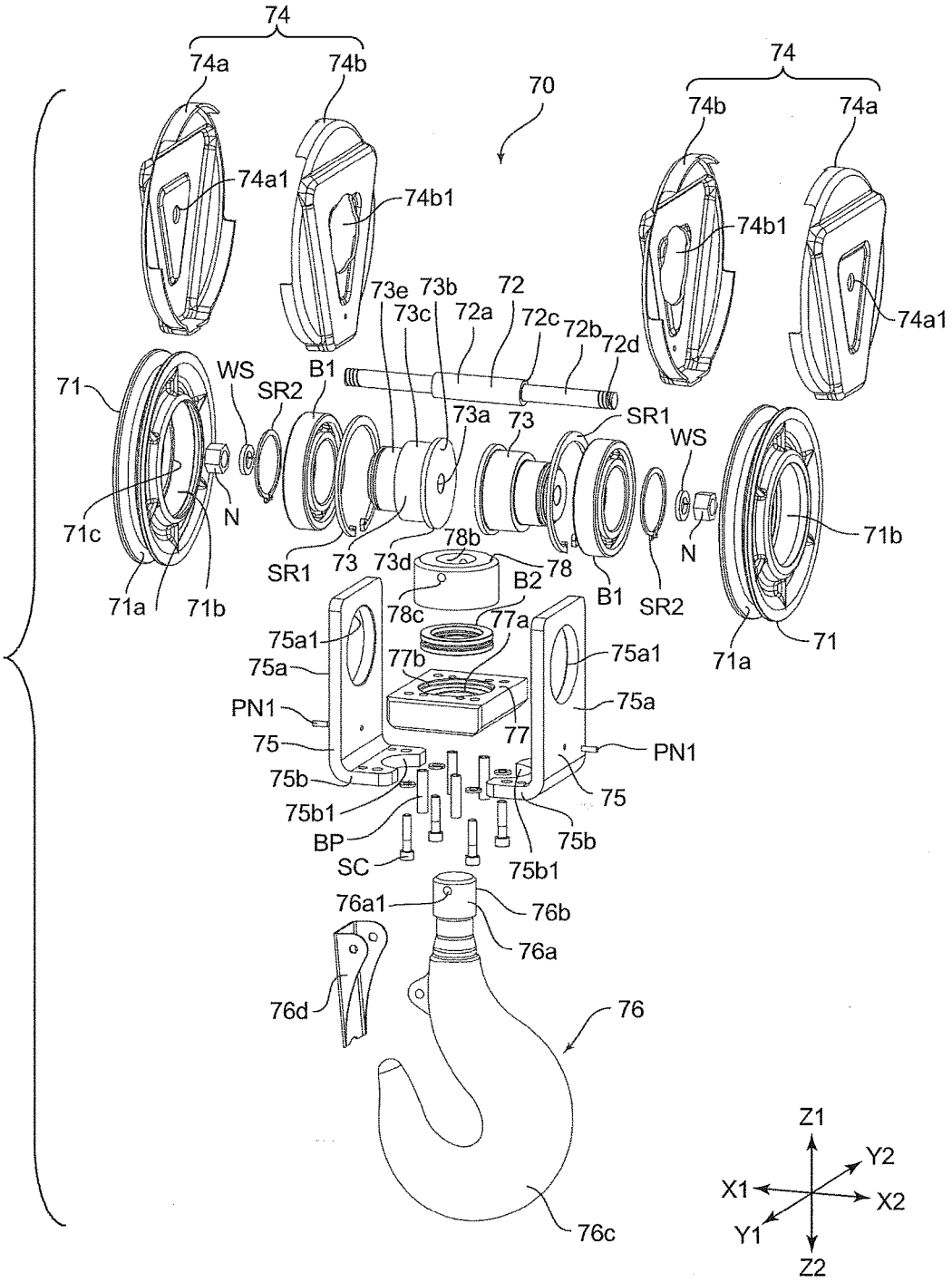
FIG. 18 is an exploded perspective view illustrating the configuration of the hook block in the rope hoist in FIG. 1.

FIG. 16 is a side view illustrating the configuration of the hook block 70. FIG. 17 is a side cross-sectional view illustrating the configuration of the hook block 70. Besides, FIG. 18 is an exploded perspective view illustrating the configuration of the hook block 70. As illustrated in FIG. 16 to FIG. 18, the hook block 70 has a pair of hook sheaves 71, and the hook sheaves 71 are attached by shaft bearings B1 to sheave shaft parts 73 attached to a coupling shaft 72.

In more detail, the coupling shaft 72 is provided with a large diameter part 72*a* and a small diameter parts 72*b*. The large diameter part 72*a* is located on the center side in the axial direction of the coupling shaft 72, and is provided to be larger in diameter than the small diameter parts 72*b*. However, the large diameter part 72*a* is provided to be much smaller in diameter than the sheave shaft parts 73. Further, the small diameter parts 72*b* are provided at portions of the coupling shaft 72 nearer both ends than is the large diameter part 72*a*. The small diameter parts 72*b* are portions to be inserted into shaft holes 73*a* of the sheave shaft parts 73 and project, on both end portion sides, from the shaft holes 73*a*.

Here, at a boundary portion between the large diameter part 72*a* and the small diameter parts 72*b*, stepped parts 72*c* are provided. The stepped parts 72*c* abut on end surfaces 73*b* facing each other of the pair of sheave shaft parts 73. The abutment inhibits the pair of sheave shaft parts 73 from moving in directions to get closer to each other. In other words, even if forces acts, from later-described brackets 75, on the pair of sheave shaft parts 73 in directions to cause them closer to each other, the abutment of the end surfaces 73*b* at the stepped parts 72*c* receives the forces.

Note that as illustrated in FIG. 18, on both end sides of the coupling shaft 72, thread parts 72*d* are provided. The thread parts 72*d* have portions projecting further to end portion sides in the axial direction than are the covers 74. Therefore, nuts N are screwed to the thread parts 74*d* via washers WS to decide the positions in the axial direction of the sheave shaft parts 73, the covers 74, and the hook sheaves 71.

Besides, the coupling shaft 72 is preferably in a range of ⅙ to ⅔ of the inner diameter of the shaft bearing B1 (the outer diameter of a shaft bearing support part 73*e*), and particularly preferably ⅓ of the inner diameter of the shaft bearing B1 (the outer diameter of the shaft bearing support part 73*e*). Note that the large diameter part 72*a* of the coupling shaft 72 may be in the above-described range, but the small diameter parts 72*b* or the thread parts 72*d* may be within the above-described range.

As illustrated in FIG. 17 and FIG. 18, the sheave shaft part 73 is provided with the shaft hole 73*a* penetrating in the axial direction at the center in the radial direction into which the above-described coupling shaft 72 is to be inserted. Further, on the outer periphery of the sheave shaft part 73, a bracket support part 73*c*, a flange part 73*d*, and the shaft bearing support part 73*e* are provided. The bracket support part 73*c* is a portion to which the later-described bracket 75 is attached, and is fitted into a fitting hole 75*a*1 of the bracket 75, for example, by press fit or the like, and is provided to be smaller in diameter than the flange part 73*d*. Therefore, the flange part 73*d* is not fitted into the fitting hole 75*a*1 but is locked on its outer peripheral side.

Further, the shaft bearing support part 73*e* is provided to be smaller in diameter than the bracket support part 73*c*, and the shaft bearing B1 is arranged on the outer peripheral side of the shaft bearing support part 73*e*. On the outer peripheral side of the shaft bearing B1, the hook sheave 71 is attached, whereby the hook sheave 71 is supported to be rotatable with respect to the coupling shaft 72. Note that inside (on the center side in the axial direction) and outside (on the end portion side in the axial direction) of the shaft bearing B1, snap rings SRL SR2 are arranged respectively, and function as pulling-out preventers for the shaft bearing B1.

The hook sheave 71 is a pulley having a groove part 71*a* around which the wire rope W is to be wound. On the inner peripheral side of the ring-shaped hook sheave 71, an inner peripheral hole 71*b* is provided. On an inner wall on the end portion side in the axial direction of the inner peripheral hole 71*b*, a locking part 71*c* is provided at which the shaft bearing B1 is locked (refer to FIG. 18).

Besides, the most on the outer peripheral side of the hook sheave 71 is covered with a cover 74 for preventing entangling of a foreign substance. The cover 74 is constituted by assembling an outside cover 74*a* and an inside cover 74*b* as illustrated in FIG. 18. Note that the inside cover 74*b* is attached to a long piece part 75*a* of the bracket 75 via a fixing means such as an attachment pin PN. As illustrated in FIG. 16, in a state where the outside cover 74*a* and the inside cover 74*b* are assembled, the cover 74 is provided with an opening 74*c* for leading the wire rope W out. Further, the outside cover 74*a* is provided with a through hole 74*a*1, and the thread part 72*d* of the coupling shaft 72 projects to the outside through the through hole 74*a*1. Further, the inside cover 74*b* is provided with an attachment hole 74*b*1, and the attachment hole 74*b*1 communicates with a later-described fitting hole 75*a*1 to enable the bracket support part 73*c* of the sheave shaft part 73 to be located therein.

To support the above-described sheave shaft parts 73, the pair of brackets 75 are provided. As illustrated in FIG. 16 to FIG. 18, the bracket 75 is provided having an external appearance in an almost L-shape. The long piece part 75*a* (corresponding to a first piece part) of the L-shape is provided with the fitting hole 75*a*1 into which the above-described sheave shaft part 73 is to be fitted by press fit or the like. Into the fitting hole 75*a*1, the bracket support part 73*c* of the sheave shaft part 73 is press-fitted, and the above-described sheave shaft part 73 abuts on the inner wall side of the long piece part 75*a*.

Further, a short piece part 75*b* (corresponding to a second piece part) orthogonal to the long piece part 75*a* is arranged in a state such that its tip end side faces the short piece part 75*b* of the other bracket 75. Thus, a housing space P1 is formed, which is surrounded by the long piece parts 75*a* and the short piece parts 75*b*.

Further, on tip end sides facing each other of the short piece parts 75*b*, half-shaped opening 75*b*1 are provided, and two openings 75*b*1 face each other to form an insertion hole 75*b*2 (refer to FIG. 17) through which a rotatable support part 76*a* of a hook 76 is inserted.

In the above-described housing space P1, a hook receiving part 77 is arranged. Note that the hook receiving part 77 corresponds to a bracket fixing member. The hook receiving part 77 has an external appearance in a thick rectangular shape, and is provided, on the center side, with a through hole 77*a* through which the rotatable support part 76*a* of the hook 76 is inserted from the lower side (Z2 side). Further, the hook receiving part 77 is provided to come into surface contact with the lower surface sides of the pair of short piece parts 75*b*, and fixed to the short piece parts 75*b* by fixing means such as screws SC, spring pins BP and so on. The fixing of the short piece parts 75*b* to the hook receiving part 77 makes the position of the brackets 75 fixed.

On the upper surface side of the hook receiving part 77, a recessed part 77*b* is provided. In the recessed part 77*b*, a shaft bearing B2 is housed. The shaft bearing B2 is, for example, a thrust bearing, and rotatably supports a support nut 78 arranged on the top of the shaft bearing B2. Note that on the lower surface side of the support nut 78, a recessed part 78*a* for housing the upper side of the shaft bearing B2 is provided.

The support nut 78 corresponds to a hook support member. On the inner peripheral side of the support nut 78, a threaded hole 78*b* is provided, and a male thread part 76*b* on the outer peripheral side of the rotatable support part 76*a* of the hook 76 is screwed into the threaded hole 78*b*. Further, the support nut 78 is provided with a through hole 78*c* extending from the outer peripheral surface to the center in the radial direction. The through hole 78*c* communicates with a through hole 76*a*1 of a later-described rotatable support part 76*a*, and a locking pin 79 is inserted into the through holes 78*c*, 76*a*1. This constitutes the threaded hole 78*b* and the later-described male thread part 76*b* such that their screwed state is not loosened.

The hook 76 has the rotatable support part 76*a* and a hook main body part 76*c*. The rotatable support part 76*a* is a portion projecting upward further than is the hook main body part 76*c*, and is provided having a circular shape in a cross-section. On the outer peripheral side on the upper side of the rotatable support part 76*a*, the male thread part 76*b* is provided, and the male thread part 76*b* is screwed into the threaded hole 78*b*. Further, the hook main body part 76*c* is a portion on which a cargo is hooked, and has an external appearance in a hook shape.

To the hook main body part 76*c*, a lever 76*d* for preventing the hooked cargo from coming off it. The lever 76*d* has one end side located on the upper side (Z1 side), and provided to be pivotable on the pivot 76*e* which is located on the one end side as a pivot. Further, the other end side of the lever 76*d* is located on the lower side (Z2 side) and provided to abut on the inner periphery of the tip side of the hook main body part 76*c*. The lever 76*d* is provided such that biasing force by a not-illustrated spring acts thereon to cause the other end side to abut on the inner periphery of the tip side of the lever 76*d* at all times. Thus, in a state where no external force acts on the lever 76*d*, the closed state of the lever 76*d* can be maintained to prevent the lever 76*d* from opening and the cargo from dropping.

<8. Comparison Between the Hook Block 70 in This Embodiment and the Conventional Configuration and So On>

Incidentally, in the conventional configuration illustrated, for example, in PTL 1, a hook receiving portion formed by casting or the like exists between covers in which a pair of hook sheaves are built, and the hook sheaves are rotatably supported on both end sides in the radial direction of the hook receiving portion. Further, the hook receiving portion rotatably supports a hook. As described above, in the configuration disclosed in PTL 1, the hook receiving portion existing between the covers is large and therefore the weight is also heavy. Further, the weight on the upper side than a hook block is heavy, and as a result when the position of the center of gravity of the hook block becomes high, the hook block is easy to incline in a state of suspending no cargo.

In particular, in the configuration of PTL 1, the hook receiving portion is a member which needs to have stiffness because a rotation shaft for supporting the pair of hook sheaves is attached thereto or a portion for rotatably supporting the hook is provided on its lower side, and is therefore difficult to downsize.

In contrast to the above, in this embodiment, not the hook receiving portion with a heavy weight formed by casting or the like as in PTL 1, but the coupling shaft 72 with a small diameter and the sheave shaft parts 73 are used between the hook sheaves 71. In particular, between the pair of sheave shaft parts 73, the hook receiving portion with a large thickness as in the conventional configuration does not exist, but the coupling shaft 72 with a small diameter is arranged. Therefore, it is possible to significantly reduce the weight on the upper side (Z1 side) than the hook 76.

In the case of reducing the weight on the upper side (Z1 side) than the hook 76 as described above, the center of gravity of the whole of the hook block 70 comes into a state of being lowered to the lower side (Z2 side). Then, particularly in a state of suspending no cargo, the inclination of the hook block 70 becomes smaller. This appearance is illustrated in FIG. 16. In FIG. 16, the center of gravity of the hook block 70 in this embodiment is indicated with a center of gravity G1, and an example of the center of gravity of the hook block in the conventional configuration is indicated with a center of gravity G2. Note that the centers of gravity G1, G2 normally exist at positions slightly displaced with respect to a center line K in the up-down direction in the state where the hook block 70 is suspended in the vertical direction (Z-direction) without inclination.

Here, the hook 76 is rotatably provided by the shaft bearing B2. Therefore, the actual inclination of the hook block 70 is not always in a determined direction but may point in various directions.

As is clear from FIG. 16, in the case where the center of gravity G1 is located at a position lower than the center of gravity G2, in a state where no cargo is suspended, an inclination angle θ1 of the hook block 70 is smaller than an inclination angle θ2 of the hook block in the conventional configuration. Here, the pair of hook sheaves 71 rotate in directions different from each other in a hoisting or lowering state of the wire rope W. In this case, the hook block 70 rotates in a direction of twisting the wire rope W by the action of a gyroscopic moment. However, if such rotation occurs in the hook block 70, the behavior of the hook block 70 does not become unstable but becomes stable when the inclination angle θ1 of the hook block 70 is small. Besides, when the inclination angle becomes large like the inclination angle θ2, the rotation in the direction of twisting the wire rope W becomes faster, but at a small inclination angle like the above inclination angle θ1, the rotation in the direction of twisting the wire rope W becomes slower, thereby also stabilizing the behavior of the hook block 70.

Note that the inclination angle θ1 is generally 3 to 4 degrees, and may be a smaller angle within 4 degrees.

Besides, in this embodiment, the hook receiving part 77 is fixed to both of the pair of short piece parts 75*b* with screws SC and so on. In addition, the coupling shaft 72 with a small diameter and the pair of sheave shaft parts 73 are supported on the long piece parts 75*a* side of the brackets 75 each in an almost L-shape. Therefore, it becomes possible to secure sufficient strength in a bending direction and twisting direction of the coupling shaft 72 and in a shearing direction of the coupling shaft 72 while reducing the weight on the upper side (Z1 side) of the hook block 70.

In other words, in the conventional configuration, the hook sheaves and the hook are supported by the large and heavy hook receiving portion, but there is no other portion supporting the hook sheaves and the hook. Therefore, considering the suspension of a heavy cargo from the hook, the conventional configuration is in a state where unless the hook receiving portion is made large and the support shaft for the hook sheaves projecting from the hook receiving portion is made large, the sufficient strength in the bending direction and twisting direction of the support shaft and in the shearing direction of the coupling shaft 72 cannot be obtained.

In contrast to the above, in this embodiment, the hook receiving part 77 is firmly fixed to the pair of short piece parts 75*b* by the screws SC and so on, and the coupling shaft 72 and the sheave shaft parts 73 are supported on the long piece parts 75*a*. In addition, the coupling shaft 72 is provided to become a bridge between the pair of brackets 75, the stepped parts 72*c* of the coupling shaft 72 abut on the end surfaces 73*b* of the sheave shaft parts 73, and the flange parts 73*d* of the sheave shaft parts 73 abut on the inside surfaces of the long piece parts 75*a*. In addition, to the coupling shaft 72, the nuts N are screwed on the outside of the covers 74.

In the case of employing such a configuration, even when a cargo is suspended from the hook 76, force becomes hard to act in the bending direction of the coupling shaft 72 because of the configuration in which the sheave shaft parts 73 and the pair of brackets 75 are located between the hook 76 and the wire rope W. In addition, force becomes hard to act in the shearing direction of the coupling shaft 72 and force also becomes hard to act in the twisting direction of the coupling shaft 72 because the sheave shaft parts 73 and the pair of brackets 75 receive the load, between the hook 76 from which the cargo is suspended and the wire rope W.

Therefore, even though the coupling shaft 72 is reduced in diameter to significantly reduce the weight on the upper side (Z1 side) of the hook 76, it is possible to increase the strength against bending, twisting, and shearing to the coupling shaft 72.

Note that in this embodiment, the pair of short piece parts 75*b* are not in an integral structure but are separated from each other. Therefore, when a heavy cargo is suspended from the hook 76, force acts on the long piece parts 75*a* in a direction of getting closer to each other (getting narrower upward) toward the upper side (Z1 side). However, the stepped parts 72*c* of the coupling shaft 72 abut on the end surfaces 73*b* of the sheave shaft parts 73, and the flange parts 73*d* of the sheave shaft parts 73 abut on the inside surfaces of the long piece parts 75*a*. Therefore, even if the force acts on the long piece parts 75*a* in a direction of getting closer to each other (getting narrower upward) toward the upper side (Z1 side), the configuration can satisfactorily resist the force.

Further, in this embodiment, the brackets 75 each in an almost L-shape are used. Comparing with a case of using ordinary flat plate-shaped brackets in place of the brackets 75 each in an almost L-shape, there is an advantage as follows. More specifically, in the case of using the flat plate-shaped brackets, when the hook receiving part 77 is tried to be fixed to the brackets, the screws SC and so on for fixing the hook receiving part 77 are configured to project on the covers 74 side. In this case, the covers 74 may interfere with the screws SC, and therefore the flat plate-shaped brackets need to project to the lower side (Z2 side) so as to secure a space for installing the screws SC.

However, in the case of such a configuration, the screws SC are located on the lower side so as not to interfere with the covers 74, whereby the position of the hook receiving part 77 is located also on a lower position, with which the hook 76 is also located on a lower side. Then, the hook 76 projects unnecessarily downward even though the inclination angle θ1 falls within a prescribed range of, for example, 3 to 4 degrees.

Such projection downward of the hook 76 is not preferable. This is because the rope hoist 10 called a low-head type is sometimes installed in a building with a low ceiling, and sometimes needs to hoist upward as much as possible a cargo with a large vertical dimension relative to the lifting height. In such a case, the hook located on the lower position undesirably leads to a reduction in lifting height.

In contrast to this, in this embodiment, the brackets 75 are each formed in an almost L-shape having the long piece part 75*a* and the short piece part 75*b*, and the hook receiving part 77 is fixed at the short piece parts 75*b* distant from the covers 74 with the screws SC and so on. This provides a configuration that the screws SC and so on do not interfere with the covers 74, resulting in a configuration that the hook 76 is not located at an unnecessarily lower position.

<9. Regarding the Counterweight 80>

Subsequently, the counterweight 80 will be described. As illustrated in FIG. 1 to FIG. 7, the rope hoist 10 is provided with the counterweight 80. The counterweight 80 is provided to achieve a balance in the width direction (Y-direction) of the rope hoist 10. More specifically, the rope drum mechanism 30 composed of many components is provided on the other end side (Y2 side) in the width direction (Y-direction) of the rope hoist 10, and has a relatively heavy weight. To achieve a weight balance with the rope drum mechanism 30, the counterweight 80 is coupled to the one end side (Y1 side) in the width direction (Y-direction) of the coupling bar 24.

The counterweight 80 is a plate-shaped member composed of a thick steel plate or the like, and is provided to spread over the pair of coupling bars 24. In addition, in this embodiment, the counterweight 80 is provided to have an area in an XZ plane larger than those of the control unit 90 and the braking resistor 100. Therefore, the counterweight 80 is provided to have a weight relatively heavy but sufficiently smaller than the total weight of the rope drum mechanism 30. Therefore, to achieve a balance in moment in the width direction (Y-direction), the distance between the counterweight 80 and the front-rear frame 21 on the one side (Y1 side) is provided longer than the distance between the rope drum mechanism 30 and the front-rear frame 21 on the other side (Y2 side).

Such an arrangement of the counterweight 80 provides the relatively large space SP between the intermediate sheave body 50 and the counterweight 80 as illustrated in FIG. 3, FIG. 4, FIG. 7 and so on.

<10. Regarding the Control Unit 90>

Subsequently, the control unit 90 will be described. The control unit 90 is a portion that controls drive of the rope hoist 10 including the drum motor 33, the traversing motor 42 and so on. Therefore, in the control unit 90, a control device for executing the control of them is arranged. Note that examples of the control device include a main control unit, a motor driver, a power supply and so on that administer control of the whole, and they are covered by a cover member 91. The control unit 90 is also provided with a braking circuit for performing a control when passing current through the braking resistor 100. The control unit 90 is fixed to a surface on the one side (Y1 side) of the counterweight 80 by a screw or the like.

<11. Regarding the Braking Resistor 100>

Subsequently, the braking resistor 100 will be described. The braking resistor 100 corresponds to a braking resistor part and is provided to inverter-control the drum motor 33, and makes the driving frequency of the drum motor 33 lower than that in operation to thereby cause it to exert a regenerative braking ability. The braking resistor 100 includes a resistor element (not illustrated), and passes electric energy returned from the drum motor 33 through the resistor element to thereby convert the electric energy to heat. Then, through the conversion to heat, the rotation speed of the drum motor 33 is suppressed.

Note that as the resistor element of the braking resistor 100, any resistor element may be used as long as it can cope with large current such as an enamel resistor, a cement resistor or the like.

FIG. 19 is a perspective view illustrating the internal configuration of the braking resistor 100. As illustrating in FIG. 19, the braking resistor 100 includes resistor units 101 in which heat release fin members 102 are arranged to surround the not-illustrated resistor element, and the resistor units 101 are fixed to the counterweight 80 via attachment stays 103 by screws or the like. A resistor cover 104 of the braking resistor 100 is attached in an opened state to the counterweight 80 as described above, whereby the heat is conducted also to the counterweight 80 so that the counterweight 80 can fulfill the function as a heat sink plate.

Besides, the resistor units 101 are entirely covered by the resistor cover 104, and the resistor cover 104 is provided with many heat release slits 104*a* being opening portions for heat release. In this embodiment, the heat release slits 104*a* are each provided in a long perforation shape, and configured such that the heat release slits 104*a* at multiple tiers are arranged in a plurality of rows.

Here, the braking resistor 100 is attached to a surface on the other side (Y2 side) in the width direction (Y-direction) of the counterweight 80. Therefore, the braking resistor 100 is provided to project to the space SP side. FIG. 20 is a plan view illustrating the appearance of the braking resistor 100 projecting to the space SP.

As illustrated in FIG. 20, the braking resistor 100 is arranged not overlapping with other members such as the traversing motor 42, the pair of coupling bars 24 and so on even in the vertical direction (Z-direction). Therefore, the dimension of the braking resistor 100 in the vertical direction (Z-direction) can be made large. Further, the dimension of the rope hoist 10 in the vertical direction (Z-direction) can also be made small. Further, because the dimension in the vertical direction (Z-direction) can also be made small, the cargo suspended from the hook 76 can be raised by an amount corresponding to the reduction in dimension.

The rope hoist 10 needs to be satisfactorily mounted on the rail R also in a case where the rail R has an assumed maximum width (including a case where a plurality of rails R are arranged including a case where two rails R are arranged). Therefore, even when the rail R has the assumed maximum width, the front-rear frame 21 on the one side needs to be moved to the one side (Y1 side) in the width direction (Y-direction) with respect to the coupling bars 24 into a state where the wheel 41 is movable upward while going around the flange part R1. More specifically, when the wheel 41 is mounted on the rail R having the assumed maximum width, the wheels 41 on both sides in the width direction (Y-direction) need to be moved upward while going around the flange parts R1 for the mounting.

Here, the position of the front-rear frame 21 on the one side (Y1 side) in the case where the wheel 41 is mounted on the rail R having the assumed maximum width is regarded as a reference position, and a dimension of the intermediate sheave body 50, at the reference position, between a portion nearest the one side (Y1 side) in the width direction (Y-direction) of the intermediate sheave body 50 and a portion nearest the other side (Y2 side) in the width direction (Y-direction) of the braking resistor 100 is regarded as L1. In mounting, the front-rear frame 21 on the one side comes to be moved to the braking resistor 100 side by an amount of a total of the widths of the wheels 41 on both sides and a margin with respect to the dimension L1.

It is necessary to prevent, even though the front-rear frame 21 on the one side moves, the intermediate sheave body 50 and the braking resistor 100 from interfering with each other. Therefore, the space SP needs to be set to equal to or more than a dimension obtained by adding the total of the widths of the two wheels 41 and the margin. Note that as the dimension of the margin, an appropriate dimension can be set and the margin may be zero.

Further, the dimension may be set as follows. More specifically, the above-described dimension L1 may be a dimension obtained by adding the total of the widths of the flange parts R1 of the two rails R on which the wheels 41 are mounted and a margin. As is clear from FIG. 5 and FIG. 6, the width of the flange part R1 of the rail R is larger than the width of the wheel 41. Therefore, with the setting of such a dimension, preferable mounting becomes possible.

Here, as illustrated in FIG. 5 and FIG. 6, the lower end side (Z2 side) of the counterweight 80 is provided at the equal height to the lower end side (Z2 side) of the rope drum mechanism 30 (both their lower end sides are located on a one-dotted chain line M in FIG. 5 and FIG. 6). In addition, the height on the lower end side (Z2 side) of the braking resistor 100 is located on the upper side (Z1 side) than the height on the lower end side (Z2 side) of the counterweight 80. Therefore, it is possible to prevent the dimension of the rope hoist 10 in the height direction from decreasing as in the case where the lower end side (Z2 side) of one of them projects downward.

<12. Operation and Effect>

In the rope hoist 10 in the above configuration, in the hook block 70, the bracket 75 has the long piece part 75*a* to which the sheave shaft part 73 is attached, and the small diameter part 72*b* of the coupling shaft 72 is inserted into the shaft hole 73*a* of the sheave shaft part 73. Therefore, the coupling shaft 72 can be reduced in diameter, and the reduction in diameter enables significant reduction of the weight on the upper side (Z1 side) of the hook 76.

Therefore, the center of gravity G1 of the whole of the hook block 70 can be lowered to the lower side (Z2 side). This can reduce the inclination of the hook block 70 with respect to the vertical direction especially in a state where no cargo is suspended. Accordingly, in the hoisting or lowering state of the wire rope W, even when the pair of hook sheaves 71 are rotated in directions different from each other and rotated in directions to twist the wire rope W by the action of a gyroscopic moment, it is possible to prevent the behavior of the hook block 70 from becoming unstable when the inclination angle θ1 of the hook block 70 is small. Further, the inclination angle θ of the hook block 70 becomes small and thereby makes it possible to slow the rotation in the direction of twisting the wire rope W, thereby also making it possible to prevent the behavior of the hook block 70 from becoming unstable.

Further, in this embodiment, the hook receiving part 77 is fixed to both of the pair of brackets 70. In addition, the coupling shaft 72 and the pair of sheave shaft parts 73 are supported on the brackets 75. Therefore, the load when a cargo is suspended from the hook 76 is received by the hook receiving part 77 and the brackets 75 and acts on the sheave shaft parts 73. Therefore, it becomes possible to secure sufficient strength in the bending direction and twisting direction of the coupling shaft 72 and in the shearing direction of the coupling shaft 72 while reducing the weight on the upper side (Z1 side) of the hook block 70 by reducing the diameter of the coupling shaft 72.

Further, the hook receiving part 77 is supported on the short piece parts 75*b* of the brackets 75 each in an almost L-shape. Therefore, it becomes possible to increase the area of a portion which receives the load, as compared with the case of using ordinary flat plate-shaped brackets, thereby making it possible to improve the strength of the hook block 70.

Further, in this embodiment, the sheave shaft parts 73 are provided with the flange parts 73*d* that abut on the inner wall sides of the long piece parts 75*a* and cannot be inserted through the shaft holes 73*a*, and the coupling shaft 72 is provided with the stepped parts 72*c* that abut on the end surfaces on the sides facing each other of the sheave shaft parts 73. Further, sides closer to the end portions in the axial direction than are the stepped parts 72*c* are inserted through the shaft holes 73*a*, whereas sides closer to the center in the axial direction than are the stepped parts 72*c* are provided to be incapable of being inserted through the shaft holes 73*a*. In a loaded condition of suspending the cargo from the hook 76, the abutment of the flange parts 73*d* on the inner wall sides of the long piece parts 75*a* and the abutment of the stepped parts 72*c* on the end surfaces 73*b* of the sheave shaft parts 73 inhibits the long piece parts 75*a* from getting closer to each other.

In other words, as for the pair of short piece parts 75*b* separated from each other, when a heavy cargo is suspended from the hook 76, force acts on the long piece parts 75*a* in a direction of getting closer to each other (getting narrower upward) toward the upper side (Z1 side). However, the stepped parts 72*c* of the coupling shaft 72 abut on the end surfaces 73*b* of the sheave shaft parts 73 and the flange parts 73*d* of the sheave shaft parts 73 abut on the inside surfaces of the long piece parts 75*a*. Therefore, even if the force acts thereon in a direction of getting closer to each other (getting narrower upward) toward the upper side (Z1 side), it is possible to satisfactorily resist the force. This can improve the strength of the hook block 70.

Further, in this embodiment, the pair of short piece parts 75*b* are fixed to the hook receiving part 77 via the screws SC, spring pins BP and so on, and the hook receiving part 77 is provided with the through hole 77*a* through which the rotatable support part 76*a* is inserted. Further, the support nut 78 is arranged on the upper side (Z1 side) of the hook receiving part 77 with the shaft bearing B2 interposed therebetween. Therefore, the fixing means such as the screws SC, spring pins BP and so on can be located on the lower side of the short piece parts 75*b* being positions not interfering with the covers 74. This makes it possible to prevent the hook 76 from being located at an unnecessarily lower position, and thereby prevent a reduction in lifting height due to the hook 76 being located at an unnecessarily lower position.

<13. Modification Examples>

The embodiment of the present invention has been described, and the present invention is variously modified in addition to them. Hereinafter, they will be described.

In the above-described embodiment, the pair of brackets 75 are each formed in an almost L-shape. However, the brackets 75 are not limited those in the almost L-shape. For example, brackets 75 each in an almost U-shape may be used. The brackets 75 in the almost U-shape are configured such that not only the short piece parts located on the lower side (Z2 side) of the long piece parts but also short piece parts located on the upper side (Z1 side) of the long piece parts exist. In this configuration, in the case where a heavy cargo is suspended from the hook 76, even if force acts on the pair of long piece parts 75*a* in a direction of getting closer to each other (getting narrower upward), it is possible to further satisfactorily resist the force. Further, it also is possible to employ a configuration in which the short piece parts located on the upper side (Z1 side) of the long piece parts are coupled to each other.

Note that other than the brackets other than those in the almost U-shape, various brackets such as flat plate-shaped brackets and so on may be used.

Besides, the bracket 75 may be provided with portions other than the long piece part 75*a* and short piece part 75*b*. For example, when it is necessary to secure the strength of a curved portion being a boundary portion between the long piece part 75*a* and the short piece part 75*b*, they may be configured such that a rib becoming a bridge between the long piece part 75*a* and short piece part 75*b* may be provided at side edge portions thereof. The rib may be integrated with the long piece part 75*a* or the short piece part 75*b*, but such a configuration that a separate rib is attached thereto may be employed. Further, the rib is preferably configured such that, for example, an XZ plane has the largest area. This makes it difficult to bend the boundary portion between the long piece part 75*a* and the short piece part 75*b*, resulting in further increased strength.

Further, in the above embodiment, the hook receiving part 77 is fixed to the short piece parts 75*b* by the screws SC, the spring pins BP and so on. However, in the case where the hook 76 may be located at a lower position, the hook receiving part 77 may be fixed using a fixing means such as the screws SC and so on at the long piece parts 75*a*. Further, in the case where the above-described ribs are provided at the brackets 75, the hook receiving part 77 may be fixed using the ribs.

Further, in the above-described embodiment, in the case the position of the front-rear frame 21 on the one side (Y1 side) when mounted on the rail R having the assumed maximum width is regarded as a reference position, the dimension L1 is set to the dimension obtained by adding the total of the widths of the wheels 41 on both sides and the margin. However, the dimension L1 may be a dimension obtained by adding a dimension between insides (the sides in contact with the flange parts R1) of the guide rollers 46 in the width direction (Y-direction), twice the distance between the inside of the guide roller 46 and the inside (on the center side of the rail R) of the wheel 41, and a margin.

Further, in the above embodiment, the drum motor 33 is described as being inverter-controlled. However, the traversing motor 42 may also be the one to be inverter-controlled.

Further, in the above embodiment, the rope hoist 10 including the trolley mechanism 40 having the traversing motor 42 is described. However, the present invention may be applied to a rope hoist including a manual type trolley mechanism but not including the traversing motor 42 as long as it includes the braking resistor 100 for inverter-controlling the drum motor 33.

Further, the rope hoist 10 in the above embodiment is a so-called 4/1 reeving type in which one end of the wire rope W is fixed to the rope drum 31, the other end of the wire rope W is fixed to the rope fixing member 60, and the intermediate sheave body 50 is arranged between them. However, the present invention is applied not only to the 4/1 reeving type. For example, the present invention may be applied to a so-called 2/1 reeving type in which one end of the wire rope W is fixed to the rope drum 31, the other end of the wire rope W is fixed to the rope fixing member 60, but the intermediate sheave body is not used. Further, the present invention may be applied to a so-called 4/2 reeving type in which one end of the wire rope W is fixed to the rope drum 31, the other end of the wire rope W is fixed to the other rope drum (the spiral groove of this rope drum is in an opposite direction to that of the rope drum 31), and the intermediate sheave body 50 is arranged between them.

The invention claimed is:

1. A hook block suspended via a wire rope and comprising a hook on which a cargo is hooked, the hook block comprising:

a pair of hook sheaves around which the wire rope is wound;

a pair of sheave shaft parts which rotatably support the respective hook sheaves;

a coupling shaft which has one side and another side across a center in an axial direction, the one side and the another side being inserted respectively into shaft holes penetrating the pair of sheave shaft parts in the axial direction;

a pair of brackets which support the sheave shaft parts fitted in fitting holes of first piece parts, comprise second piece parts substantially orthogonal to the first piece parts, and are formed with, in a state of facing each other, an insertion hole allowing an upper side of the hook to be inserted therethrough;

a bracket fixing member to which each of the pair of brackets is fixed, and which is supported by the second piece parts on an upper side of a hook main body part on which the cargo is hooked; and a hook support member which is rotatably arranged to the bracket fixing member and which is located on the opposite side of the hook across the bracket fixing member and fixed to an outer periphery on the upper side of the hook.

2. The hook block according to claim 1, wherein the sheave shaft parts are provided with flange parts which abut on inner wall sides facing each other of the pair of first piece parts and are incapable of being inserted through the shaft holes, wherein the coupling shaft is provided with stepped parts which abut on end surfaces on sides facing each other of the sheave shaft parts, sides closer to end portions in the axial direction than are the stepped parts are inserted into the shaft holes, whereas sides closer to a center in the axial direction than are the stepped parts are provided to be incapable of being inserted through the shaft holes, and wherein in a loaded condition of suspending the cargo from the hook, the abutment of the flange parts on the inner wall sides of the first piece parts and the abutment of the stepped parts on the end surfaces of the sheave shaft parts prevents the pair of the first pieces from flexing so as to get closer to each other.

3. The hook block according to claim 2, wherein the bracket fixing member is arranged on a side opposite to the hook out of the second piece parts, wherein each of the pair of second piece parts is fixed to the bracket fixing member via a fixing means, and the bracket fixing member is formed with a through hole through which the upper side of the hook is inserted, and wherein the hook support member is arranged on a side opposite to the hook out of the bracket fixing member with a shaft bearing interposed therebetween.

4. A rope hoist including the hook block according to claim 2.

5. The hook block according to claim 1, wherein the bracket fixing member is arranged on a side opposite to the hook out of the second piece parts, wherein each of the pair of second piece parts is fixed to the bracket fixing member via a fixing means, and the bracket fixing member is formed with a through hole through which the upper side of the hook is inserted, and wherein the hook support member is arranged on a side opposite to the hook out of the bracket fixing member with a shaft bearing interposed therebetween.

6. A rope hoist including the hook block according to claim 1.

* * * * *